US008359986B2

(12) United States Patent
Sekiguchi et al.

(10) Patent No.: US 8,359,986 B2
(45) Date of Patent: Jan. 29, 2013

(54) APPARATUS, METHOD AND PROGRAM FOR PROTECTING ACCOMMODATED ITEM SUCH AS CARTRIDGE

(75) Inventors: Yukio Sekiguchi, Kato (JP); Masahiko Katada, Kato (JP); Katsufumi Onaka, Kato (JP); Takanobu Kashiwagi, Kato (JP); Akira Nanba, Kato (JP)

(73) Assignee: Fujitsu Limited, Kawasaki (JP)

( * ) Notice: Subject to any disclaimer, the term of this patent is extended or adjusted under 35 U.S.C. 154(b) by 436 days.

(21) Appl. No.: 11/948,387

(22) Filed: Nov. 30, 2007

(65) Prior Publication Data

US 2008/0178783 A1 Jul. 31, 2008

(30) Foreign Application Priority Data

Jan. 30, 2007 (JP) ..... 2007-019948

(51) Int. Cl.
*E05G 1/00* (2006.01)

(52) U.S. Cl. ..... 109/53; 70/82; 70/85; 109/56; 109/57; 109/73; 211/180; 312/216

(58) Field of Classification Search ..... 109/53–58, 109/67, 69, 73; 211/180; 312/216; 70/78, 70/81–83, 85, 86; 221/131
See application file for complete search history.

(56) References Cited

U.S. PATENT DOCUMENTS 1,075,652 A * 10/1913 Kleber ..... 312/304
1,207,066 A * 12/1916 Millice ..... 312/240
1,812,826 A * 6/1931 Frick ..... 292/1
3,464,748 A * 9/1969 Gregory ..... 312/216
4,341,166 A * 7/1982 Cantley ..... 109/53
4,608,932 A * 9/1986 Bohland et al. ..... 109/56
4,648,550 A * 3/1987 Cleary, Jr. ..... 232/25
(Continued)

FOREIGN PATENT DOCUMENTS

JP 55-52802 4/1980
JP 56-16875 2/1982
(Continued)

OTHER PUBLICATIONS

Korean Office Action issued on Jan. 14, 2009 in corresponding Korean Patent Application 10-2007-0123696.

(Continued)

*Primary Examiner* — Lloyd Gall
(74) *Attorney, Agent, or Firm* — Staas & Halsey LLP

(57) ABSTRACT

The present invention relates to protection of accommodated items such as cartridges each incorporating recording media and enhances a protection function for the accommodated items. The present invention relates to protection of accommodated items accommodated in an accommodating shelf into/out of which accommodated items (cartridges) such as cartridges each incorporating recording media such as magnetic tapes can be put/taken. The present invention includes guard bars (longitudinal bars BV and lateral bars BL) that are disposed on or in front of entrance/exit portions of a plurality of cells that accommodate the accommodated items and that obstruct putting in/taking out of the accommodated items, and the present invention includes a structure that enables loading in or loading out of the accommodated items by moving guard bars corresponding to a cell into/out of which the accommodated item is loaded, from a closed position to an opened position and that, after the loading in or the loading out, protects the accommodated item by moving the guard bars from the opened position thereof to the closed position. Thereby, the protection of the accommodated items is facilitated by a simple structure.

19 Claims, 20 Drawing Sheets

U.S. PATENT DOCUMENTS

| | | | | |
|---|---|---|---|---|
| 5,035,187 | A * | 7/1991 | McGunn | 109/46 |
| 5,435,255 | A * | 7/1995 | Elseser et al. | 109/56 |
| 5,504,325 | A * | 4/1996 | Talmon et al. | 250/222.1 |
| 5,588,724 | A * | 12/1996 | Emery | 312/236 |
| 5,820,234 | A * | 10/1998 | Capwell et al. | 312/216 |
| 5,857,418 | A * | 1/1999 | Pulec et al. | 109/56 |
| 5,915,802 | A * | 6/1999 | Siler | 312/216 |
| 5,984,121 | A * | 11/1999 | Cole | 211/183 |
| 6,700,734 | B2 | 3/2004 | Satoh | |
| 6,722,512 | B2 * | 4/2004 | Scully | 211/183 |
| 6,851,771 | B2 * | 2/2005 | Marler et al. | 312/249.8 |
| 6,921,990 | B1 * | 7/2005 | Higgins | 307/328 |
| 6,938,785 | B2 * | 9/2005 | Denny et al. | 211/183 |
| 7,028,621 | B2 * | 4/2006 | Mercier | 109/56 |
| 7,156,475 | B2 * | 1/2007 | Gloger, Jr. | 312/216 |
| 7,850,013 | B1 * | 12/2010 | Kramer et al. | 211/4 |
| 2004/0020886 | A1 * | 2/2004 | Scully | 211/183 |

FOREIGN PATENT DOCUMENTS

| | | |
|---|---|---|
| JP | 4-10266 | 1/1992 |
| JP | 92-21255 | 9/1992 |
| JP | 5-294404 | 11/1993 |
| JP | 10-255361 | 9/1998 |
| JP | 11-196964 | 7/1999 |
| JP | 2000-268550 | 9/2000 |
| JP | 2004-256242 | 9/2004 |

OTHER PUBLICATIONS

Chinese Office Action issued Jun. 23, 2010 in corresponding Chinese Patent Application 200710196208.5.

Japanese Office Action issued on Jul. 13, 2010 in corresponding Japanese Patent Application 2007-019948.

* cited by examiner

APPARATUS, METHOD AND PROGRAM FOR PROTECTING ACCOMMODATED ITEM SUCH AS CARTRIDGE

CROSS-REFERENCE TO RELATED APPLICATIONS

This application is based upon and claims the benefit of priority from the prior Japanese Patent Application No. 2007-019948, filed on Jan. 30, 2007, the entire contents of which are incorporated herein by reference.

BACKGROUND OF THE INVENTION

1. Field of the Invention

The present invention relates generally to protection of accommodated items in an accommodating shelf that stores the accommodated items such as cartridges each incorporating recording media such as magnetic recording tapes, by accommodating the items in cells, and more particularly, to a protecting apparatus that protects accommodated items such as a cartridge from falling off and being taken out such as theft, from the accommodating shelf; a protecting method thereof; and a protecting program thereof.

2. Description of the Related Art

Storage of recording media such as magnetic recording tapes, requires high level of security such as: prevention of falling off of the recording media due to an earthquake, etc.; and protection from theft such as being taken out without notice of the recording media and from data theft such as being taken out without notice of data of the recording media, etc.

As to the above storage of recording media, Japanese Utility Model Application Laid-Open Publication No. 1981-016875 discloses that a lattice having the same shape as the front shape of a storing cell unit that stores cartridges is disposed on the front of the storing cell unit, this lattice is moved when vibration is generated, and, thereby, falling off of the cartridges are prevented (the claim of the utility model, FIG. 1).

Japanese Patent Application Laid-Open Publication No. 2000-268550 discloses a cartridge library apparatus having a door that is provided for the main body thereof such that the door can be opened and closed and that is formed with multiple cells that each store a cartridge, wherein, when the door is opened, a shutter covering the opening is provided and the shutter is driven to be opened or closed (the abstract, FIG. 1).

Japanese Patent Application Laid-Open Publication No. 5-294404 discloses that, as to protection of magnetic tape media accommodated in an accommodating shelf, the accommodating shelf is moved to a fire-proof safe when an operation is finished, a fire-proof door is closed when accommodation of the accommodating shelf is completed, and the fire-proof door is opened and the accommodating shelf is moved from the fire-proof safe to a library unit when the operation is started (the abstract, FIG. 1, etc.).

With the structure described in the above '875 publication, falling off and theft of the cartridges can not be avoided because the cartridge storing cell unit is configured to be fully opened when one cartridge is taken out or stored. With the structure described in the above '550 publication, falling off, etc., of cartridges can not be prevented when the door is not fully opened because the opening formed when the door is fully opened is merely covered with the shutter. According to the above '404 publication, prevention of falling off and being taken out of cartridges from the accommodating shelf can not be facilitated because the accommodating shelf is merely moved to the fire-proof safe.

Various types of vast information processed by computers are backed up and stored by recording media such as magnetic recording tapes corresponding to the amount of information to be handled in addition to on-line disc apparatuses. Recording media such as magnetic recording tapes are handled each being contained in cartridges and are used for data exchange, external storage, etc., by the cartridge. Theft of these cartridges leads to leakage of information stored in the recording media and, therefore, encryption is effective as a measure against the leakage. However, the encryption requires encrypting apparatuses and software, and the apparatuses and the software are expensive. In addition, the encryption also requires processing for encryption.

A cartridge is stored in a storing apparatus such as a library apparatus. However, a measure is necessary to prevent falling off from the accommodating shelf due to an impact of an earthquake, etc. A typical measure can be employment of a holding mechanism that holds a cartridge using a restoring force of a spring. The holding force of the cartridge only has to be strengthened to endure fierce vibration. However, when the holding force is strengthened, the load on a conveying robot becomes heavy such as complication of the control and the mechanism for taking out the cartridge and higher prices thereof.

Another measure can be listed according to which a tongued and grooved structure that corresponds to the cartridge shape is provided instead of the holding mechanism and the cartridges are fixed using this tongued and grooved structure. To take a cartridge out of the fixed state caused by the tongued and grooved structure, control such as raising once the cartridge is necessary and the process procedure for taking out the cartridge for the conveying robot becomes complicated while the control circuit and the mechanism become complicated and expensive and the time necessary for the process for taking out the cartridge becomes long.

The above '875, '550, and '404 publications have no disclosure and no suggestion concerning the above problems and also have no disclosure and no suggestion concerning structures, etc., to solve those problems.

SUMMARY OF THE INVENTION

An object of the present invention relates to protection of accommodated items such as cartridges and is to enhance a function of protecting the accommodated items.

Another object of the present invention relates to a library apparatus that stores cartridges, and is to enhance a function of protecting accommodated items.

To achieve the above objects, the present invention relates to protection of accommodated items accommodated in an accommodating shelf into/out of which accommodated items such as cartridges each containing recording media such as magnetic recording tapes can be put and taken and, according thereto, guard bars are provided that are disposed on entrance/exit portions or in front of a plurality of cells each accommodating the accommodated items and that block putting in and taking out of the accommodated items, and a mechanism is provided that moves the guard bars from a closed position to an opened position corresponding to a cell into/from which an accommodated item is loaded in or loaded out, thereby, enables the loading in or loading out the accommodated item, and protects the accommodated item by moving the guard bars from the opened position to the closed position after the loading in or the loading out. Thereby, effects can be expected that a simple structure enables the protection and the recording medium can omit any encrypting process, etc.

In order to achieve the above objects, according to a first aspect of the present invention there is provided a protecting apparatus of accommodated items such as a cartridge accommodated in an accommodating shelf into/out of which the accommodated items can be put/taken, comprising a guard bar that is disposed on or in front of each of entrance/exit portions each of a plurality of cells accommodating the accommodated items, the guard bar obstructing putting in and taking out of the accommodated items, the guard bar being moved from a closed position to an opened position corresponding to a cell into/out of which the accommodated item is loaded.

Preferably, in the protecting apparatus of accommodated items, the guard bars may be disposed crossing each other on the entrance/exit portion. Preferably, the guard bars may be disposed in a matrix each spanning over the entrance/exit portions of the cells that are disposed in a matrix each accommodating the accommodated item.

Preferably, the guard bars may be a plurality of longitudinal bars that obstruct in the longitudinal direction the entrance/exit portions of or the front of the entrance/exit portions of the plurality of cells each accommodating the accommodated item and/or are lateral bars that obstruct in the lateral direction the entrance/exit portions of or the front of the entrance/exit portions of the plurality of cells, wherein a specific cell is selected into/out of which the accommodated item is loaded, using the longitudinal bars and/or the lateral bars. Preferably, when a conveying unit loading the accommodated item into/out of the cell is present at a position at which the unit obstructs putting in/taking out of the accommodated item through the entrance/exit portion of the cell, the guard bars may be moved to the opened position. Preferably, when the conveying unit loading the accommodated item into/out of the cell has arrived at a position at which the unit obstructs putting in/taking out of the accommodated item through the entrance/exit portion of the cell, the guard bars may be moved to the opened position at the timing of the arrival. Preferably, the opened position of the guard bars may be set at a position that overlaps a partitioning wall of the cell or in the vicinity thereof.

In order to achieve the above objects, according to a second aspect of the present invention there is provided a protecting method of accommodated items such as a cartridge accommodated in an accommodating shelf into/out of which the accommodated items can be put/taken, comprising the steps of obstructing the putting/taking of the accommodated items into/out of a plurality of cells that accommodate the accommodated items, by guard bars disposed on or in front of entrance/exit portions of the plurality of cells; moving the guard bars to an opened position for the entrance/exit portion when the accommodated items are loaded in or loaded out; and moving the guard bars to a closed position for the entrance/exit portion after the loading in or the loading out of the accommodated items.

Preferably, the guard bars may be a plurality of longitudinal bars that obstruct in the longitudinal direction the entrance/exit portions of or the front of the entrance/exit portions of the plurality of cells each accommodating the accommodated item and/or are lateral bars that obstruct in the lateral direction the entrance/exit portions of or the front of the entrance/exit portions of the plurality of cells, the method further comprising the step of selecting a specific cell into/out of which the accommodated item is loaded, using the longitudinal bars and/or the lateral bars.

Preferably, the protecting method may further comprise the step of moving the guard bars to the opened position in case where a conveying unit loading the accommodated item into/out of the cell is present at a position at which the unit obstructs putting in/taking out of the accommodated item through the entrance/exit portion of the cell. Preferably, the protecting method may further comprise the step of, in case where the conveying unit loading the accommodated item into/out of the cell has arrived at a position at which the unit obstructs putting in/taking out of the accommodated item through the entrance/exit portion of the cell, moving the guard bars to the opened position at the timing of the arrival.

In order to achieve the above objects, according to a third aspect of the present invention there is provided a protecting program that is executed by a computer and that is for accommodated items such as a cartridge accommodated in an accommodating shelf into/out of which the accommodated items can be put/taken, the program comprising the steps of obstructing the putting/taking the accommodated items into/out of a plurality of cells that accommodate the accommodated items, by guard bars disposed on or in front of entrance/exit portions of the plurality of cells; moving the guard bars to an opened position for the entrance/exit portion when the accommodated items are loaded in or loaded out; and moving the guard bars to a closed position for the entrance/exit portion after the loading in or the loading out of the accommodated items.

Preferably, the guard bars may be a plurality of longitudinal bars that obstruct in the longitudinal direction the entrance/exit portions of or the front of the entrance/exit portions of the plurality of cells each accommodating the accommodated item and/or are lateral bars that obstruct in the lateral direction the entrance/exit portions of or the front of the entrance/exit portions of the plurality of cells, the program further comprising the step of selecting a specific cell into/out of which the accommodated item is loaded, using the longitudinal bars and/or the lateral bars. Preferably, the protecting program may further comprise the step of moving the guard bars to the opened position in case where a conveying unit loading the accommodated item into/out of the cell is present at a position at which the unit obstructs putting in/taking out of the accommodated item through the entrance/exit portion of the cell. Preferably, the protecting program may further comprise the steps of, in case where the conveying unit loading the accommodated item into/out of the cell has arrived at a position at which the unit obstructs putting in/taking out of the accommodated item through the entrance/exit portion of the cell, processing of moving the guard bars to the opened position at the timing of the arrival.

Features and advantages of the present invention can be listed as follows.

(1) Accommodated items accommodated in cells of an accommodating shelf can be protected from falling off caused by vibration, theft, etc., and the reliability of the accommodation of the accommodated items can be improved.

(2) Accommodated items accommodated in cells of an accommodating shelf is protected by closing the item with guard bars and, therefore, a simple structure enables the protection and, when the accommodated items are cartridges of recording media, the protection thereof is enabled omitting processes such as encryption, etc.

(3) According to a library apparatus of the present invention, cartridges accommodated in cells of an accommodating shelf can be protected from falling off caused by vibration, from theft, etc., and liability of storage of the cartridges in the library apparatus can be improved.

Other objects, features, and advantages of the present invention will become more clear by referring to the accompanying drawings and embodiments.

DETAILED DESCRIPTION OF THE PREFERRED EMBODIMENTS

First Embodiment

Figure 1:
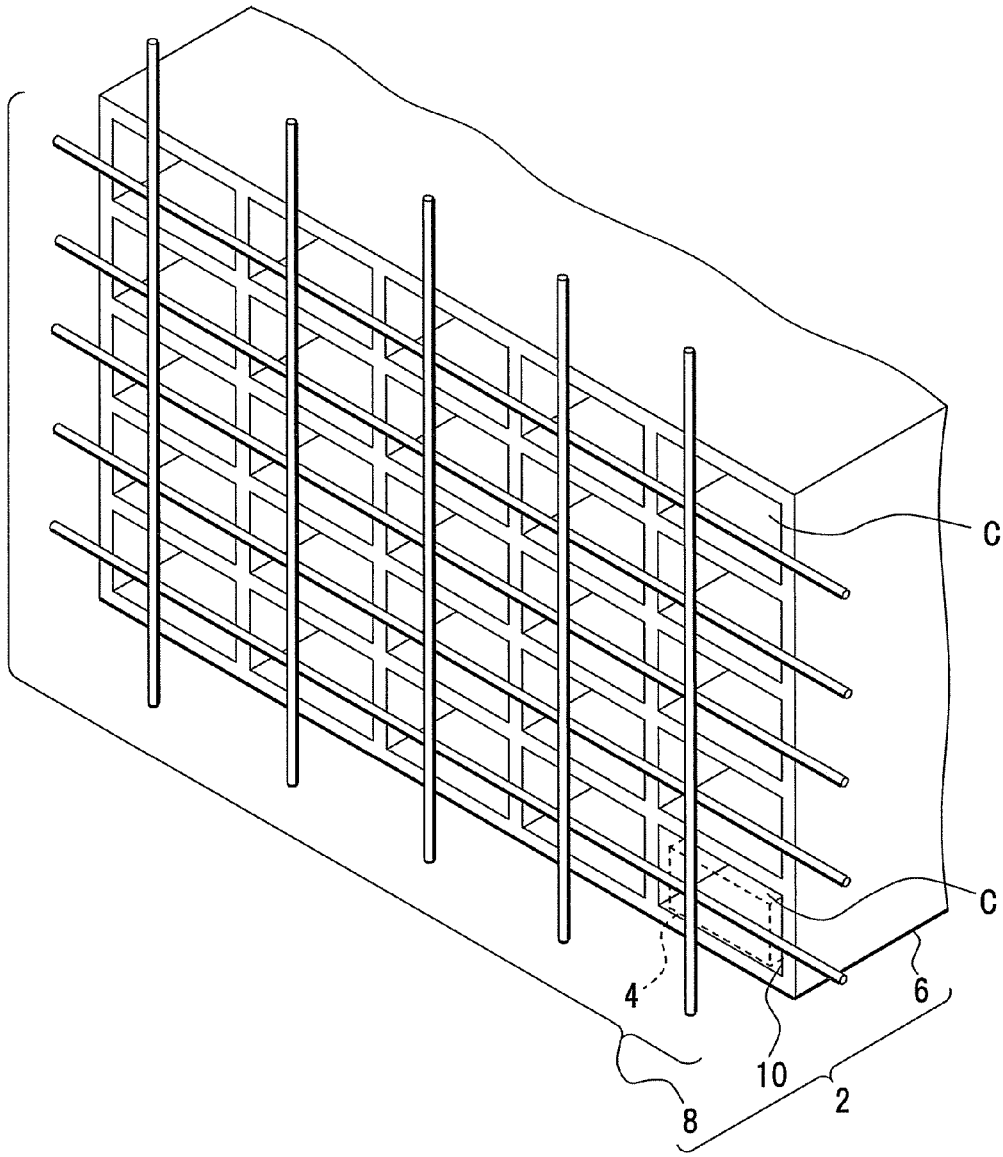
FIG. 1 is a perspective view of an exemplary structure of a cartridge protecting apparatus according to a first embodiment.
Figure 2:
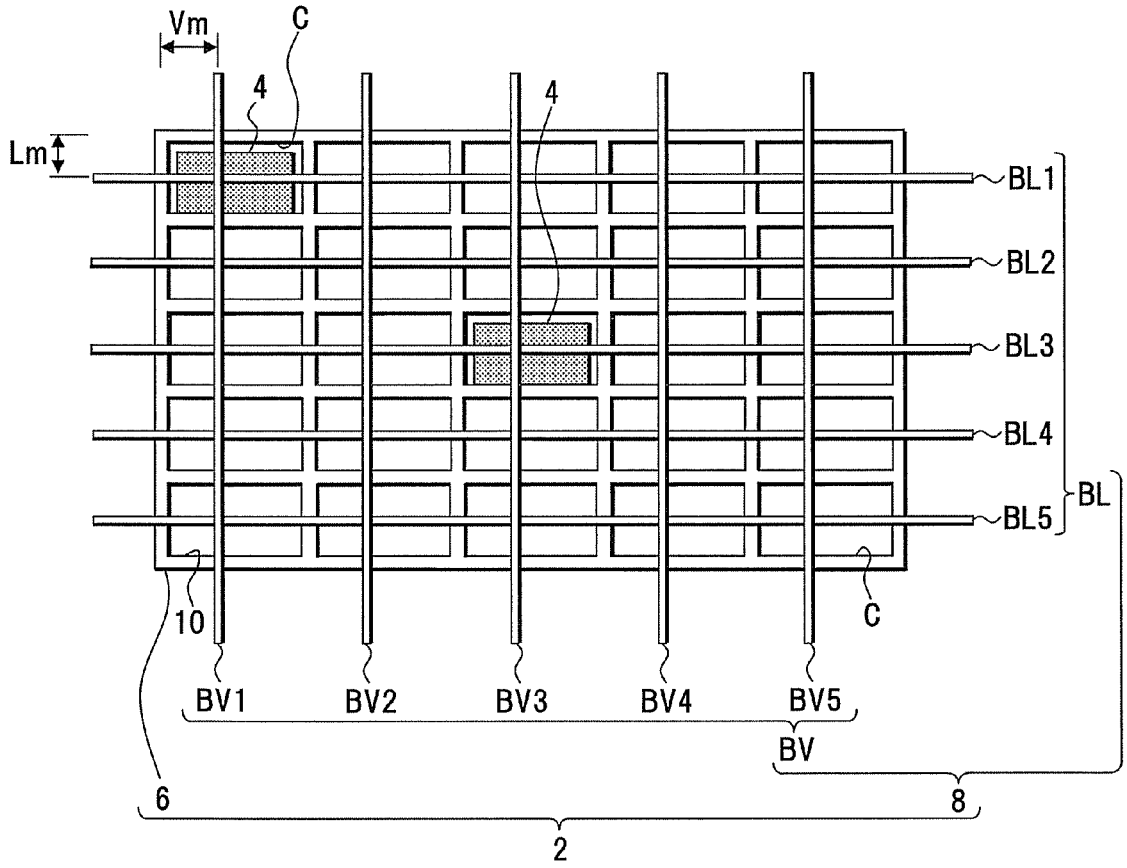
FIG. 2 depicts the exemplary structure of the cartridge protecting apparatus.
Figure 3A:
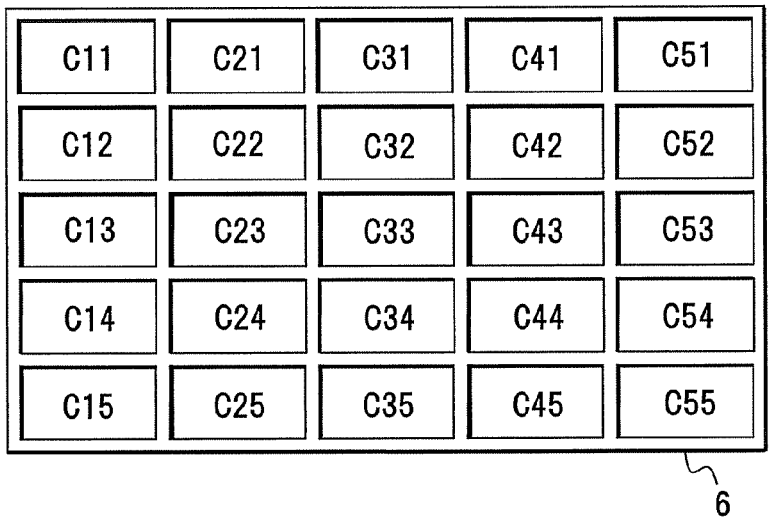
FIGS. 3A and 3B depict an accommodating shelf and a security guard mechanism unit, FIG. 3A showing the structure of the accommodating shelf and a disposition of cells, FIG. 3B showing an exemplary structure of the security guard mechanism unit.
Figure 3B:
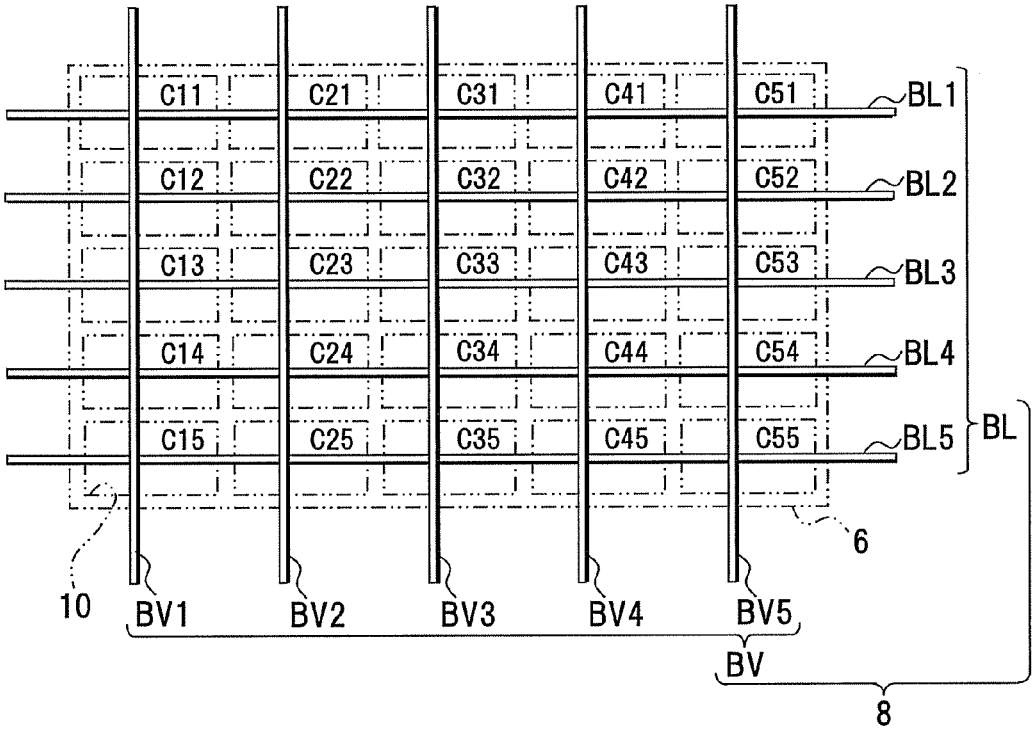
Figure 4:
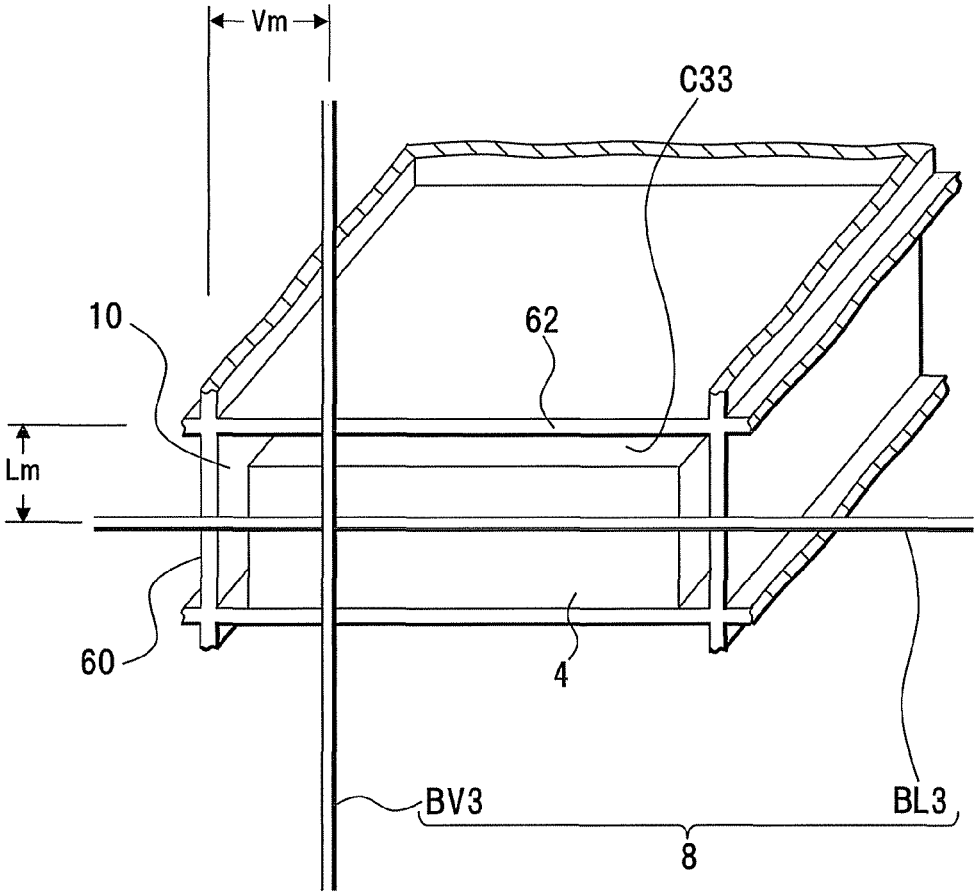
FIG. 4 depicts a closed state of the cell by a longitudinal bar and a lateral bar.
Figure 5:
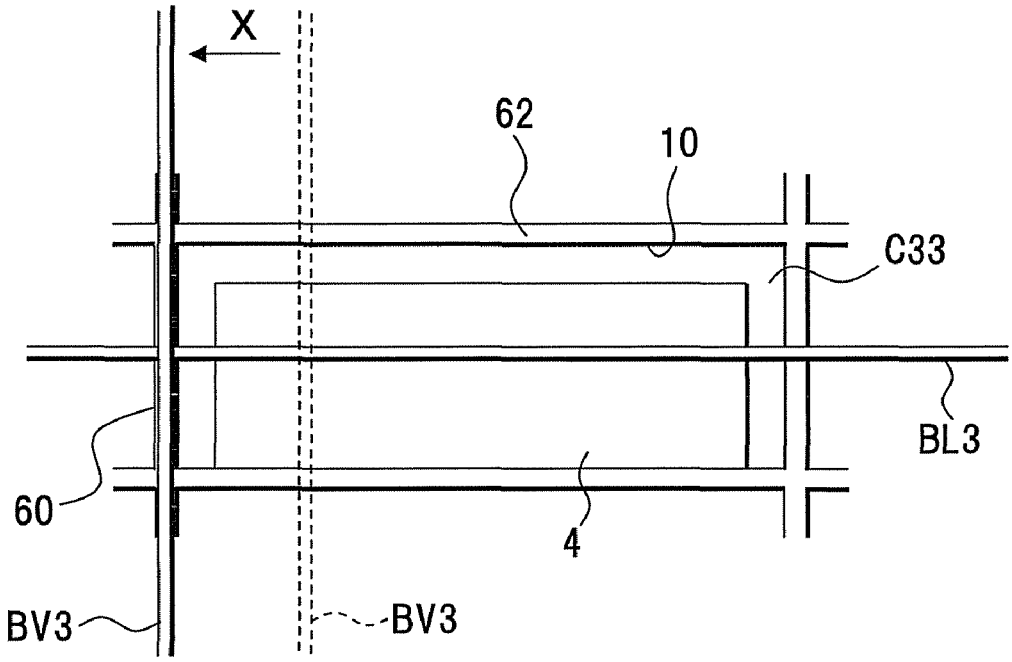
FIG. 5 depicts a closed state of the cell by the lateral bar when the longitudinal bar has been moved.
Figure 6:
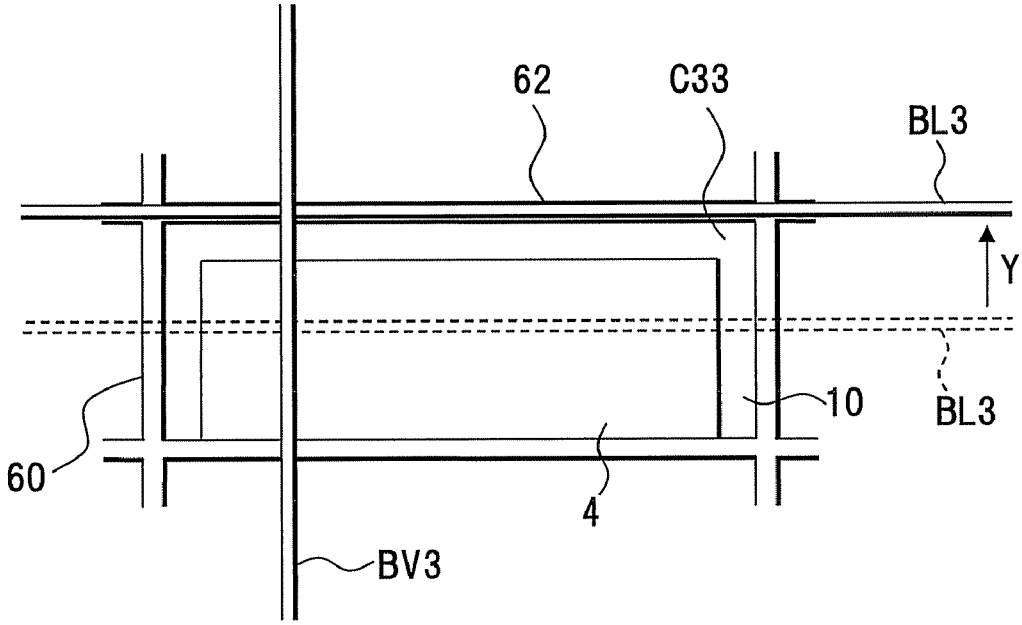
FIG. 6 depicts a closed state of the cell by the longitudinal bar when the lateral bar has been moved.
Figure 7:
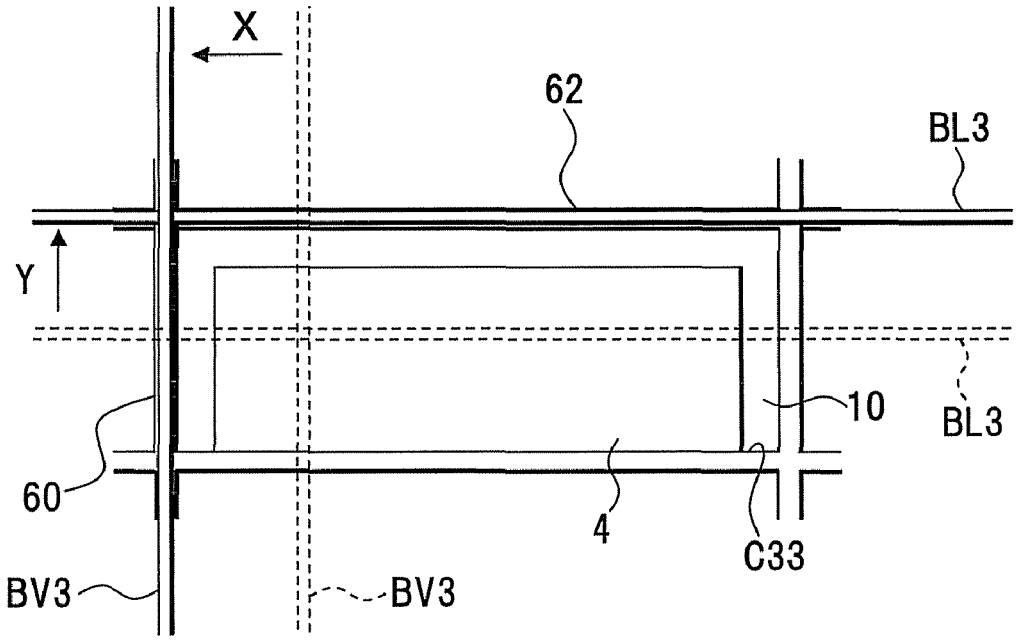
FIG. 7 depicts an opened state of the cell.

Description will be given for a first embodiment of the present invention referring to FIGS. 1 to 7. FIG. 1 depicts a perspective view of an exemplary structure of a cartridge protecting apparatus. FIG. 2 depicts the exemplary structure of the cartridge protecting apparatus. FIGS. 3A and 3B depict an accommodating shelf and a security guard mechanism unit, and FIG. 3A depicts the structure of the accommodating shelf and a disposition of cells and FIG. 3B depicts an exemplary structure of the security guard mechanism unit. FIG. 4 depicts a cell closed by the guard mechanism unit. FIG. 5 depicts an opened state of the longitudinal bar. FIG. 6 depicts an opened state of the lateral bar. FIG. 7 depicts an opened state of the longitudinal bar and the lateral bar.

This cartridge protecting apparatus 2 is an example of a protecting apparatus or a protecting method of accommodated items and, as depicted in FIGS. 1 and 2, is disposed on the accommodating shelf 6 that accommodates cartridges 4 that are accommodated items and, to protect the cartridges 4 from falling off from the accommodating shelf 6, theft, etc., the security guard mechanism unit 8 is provided for the accommodating shelf 6 in front thereof. The cartridge 4 is a cassette that stores a recording medium such as a magnetic recording tape, etc., and the cartridge 4 has, for example, an outer shape constituted of a flat cuboid.

The accommodating shelf 6 includes a plurality of cells "C" each having an accommodating space that can accommodate one single cartridge 4, with corresponding to the outer shape of the cartridge 4. Each cell C can accommodate one single cartridge 4 and includes an entrance/exit portion 10 through which one cartridge 4 can be loaded in or loaded out, in front of the accommodating shelf 6. That is, a ceiling face portion, a bottom face portion, both side face portions, and a back face portion of each cell C are closed except each entrance/exit portion 10.

The accommodating shelf 6 of the embodiment is formed with the plurality of cells C. These cells C are arranged in a matrix of m lines by n columns and are arranged in, for example, five lines by five columns. Giving different reference numerals respectively to the cells C to facilitate locating the position of each cell C, the cells C are denoted as depicted in FIG. 3A by C11, C12, . . . , C15, C21, C22, . . . , C25, . . . , C51, C52, . . . , and C55.

The security guard mechanism unit 8: is disposed in front of the entrance/exit portions 10 of the cells C of the accommodating shelf 6; obstructs the entrance/exit portions 10; thereby, prevents the cartridges 4 from falling off and taking out through the entrance/exit portions 10; and, when one of the cartridge 4 is loaded in or loaded out, only the entrance/exit portion 10 necessary therefor is selectively opened and closed. Therefore, the security guard mechanism unit 8 is disposed with a plurality of longitudinal bars BV and a plurality of lateral bars BL as guards or guard bars that close the entrance/exit portions 10 of the cells C. In this case, five longitudinal bars BV1, BV2, BV3, BV4, and BV5, and five lateral bars BL1, BL2, BL3, BL4, and BL5 are disposed respectively corresponding to the cells C that are arranged five lines by five columns. The longitudinal bars BV1, BV2, BV3, BV4, and BV5 are disposed across middle portions respectively of the entrance/exit portions 10 in the longitudinal direction, and the lateral bars BL1, BL2, BL3, BL4, and BL5 are disposed across the middle portions of the entrance/exit portions 10 in the lateral direction. The entrance/exit portions 10 are closed by the longitudinal bars BV1, BV2, BV3, BV4, and BV5, and the lateral bars BL1, BL2, BL3, BL4, and BL5 disposed crossing each other. Thereby, putting in and taking out of the cartridges 4 are prevented for each cell C. In the embodiment, each of crossing points of the longitudinal bars BV1, BV2, BV3, BV4, and BV5, and the lateral bars BL1, BL2, BL3, BL4, and BL5 is displaced from the center of each entrance/exit portion 10. This is to reduce moving ranges of the longitudinal bars BV1, BV2, BV3, BV4, and BV5, and the lateral bars BL1, BL2, BL3, BL4, and BL5 and, concurrently, to prevent coming in and going out of the cartridges 4.

Each of the longitudinal bars BV1, BV2, BV3, BV4, and BV5, and the lateral bars BL1, BL2, BL3, BL4, and BL5 is set being movable in parallel to each entrance/exit portion 10 of each cell C. Each of the longitudinal bars BV1, BV2, BV3, BV4, and BV5 is individually movable in parallel in a horizontal direction within a predetermined range and each of the lateral bars BL1, BL2, BL3, BL4, and BL5 is individually movable in parallel in a vertical direction within a predetermined range. In FIG. 2, "Vm" denotes the moving range of the longitudinal bars BV1, BV2, BV3, BV4, and BV5, and "Lm" denotes the moving range of the lateral bars BL1, BL2, BL3, BL4, and BL5.

Description will be given extracting a cell C33, a longitudinal bar BV3, and a lateral bar BL3. The longitudinal bar BV3 moves by the moving range Vm from a closed position (C position) to an opened position (O position) as depicted in FIG. 4. As depicted in FIG. 5, even in the case where the longitudinal bar BV3 has moved in parallel, to an O position at which the longitudinal bar BV3 overlaps a longitudinal partitioning wall portion 60 (arrow X), putting in and taking out of the cartridge 4 can not be executed when a lateral bar BL3 is present on the entrance/exit portion 10. The lateral bar BL3 moves by the moving range Lm from a C position to an O position as depicted in FIG. 4. As depicted in FIG. 6, even in the case where the lateral bar BL3 has moved in parallel, to an O position at which the lateral bar BL3 overlaps a lateral partitioning wall portion 62 (arrow Y), putting in and taking out of the cartridge 4 can not be executed when a longitudinal bar BV3 is present on the entrance/exit portion 10. As depicted in FIG. 7, when both of the longitudinal bar BV3 and the lateral bar BL3 have moved from the entrance/exit portion 10 to the O positions on the partitioning wall portions 60 and 62 of a cell C 33 (arrows X, Y), the entrance/exit portion 10 is in the opened state thereof and the cartridge 4 can be put in and taken out.

Figure 8A:
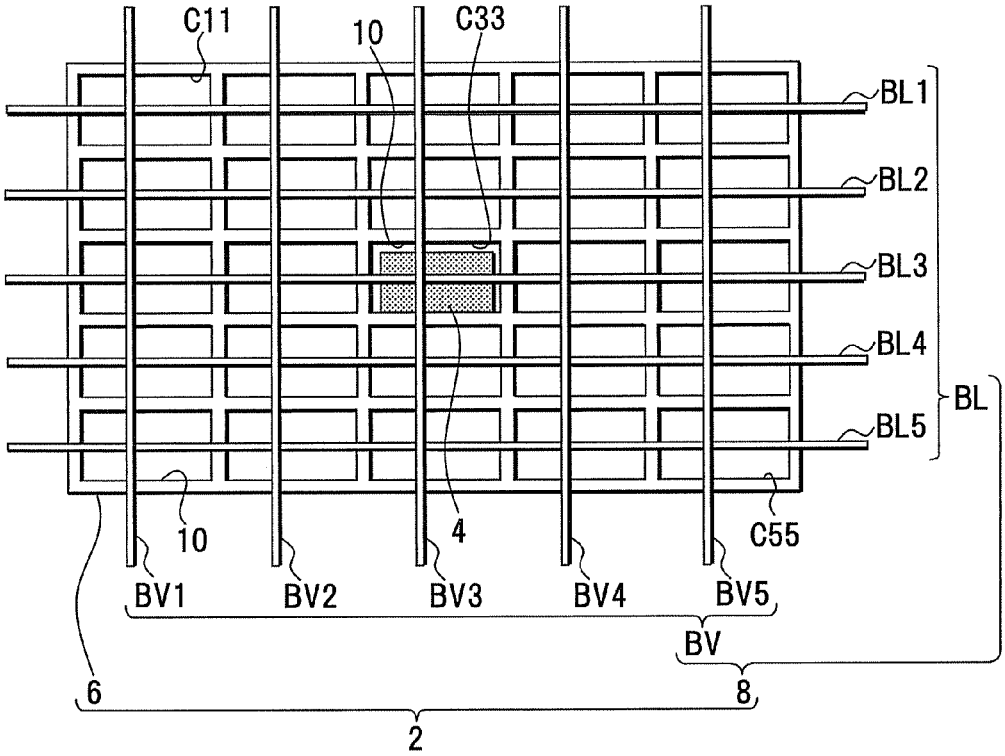
FIGS. 8A and 8B depict a closed and an opened states of the accommodating shelf, FIG. 8A showing the closed state of each cell of the accommodating shelf, FIG. 8B showing the accommodating shelf with a specific cell in the opened state.
Figure 8B:
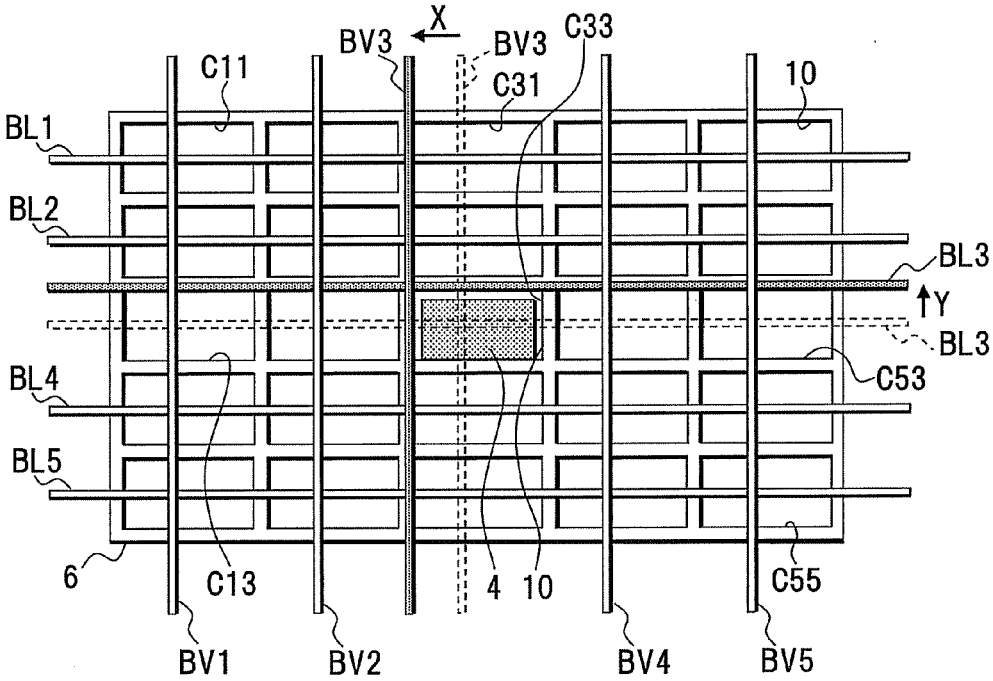
Figure 9:
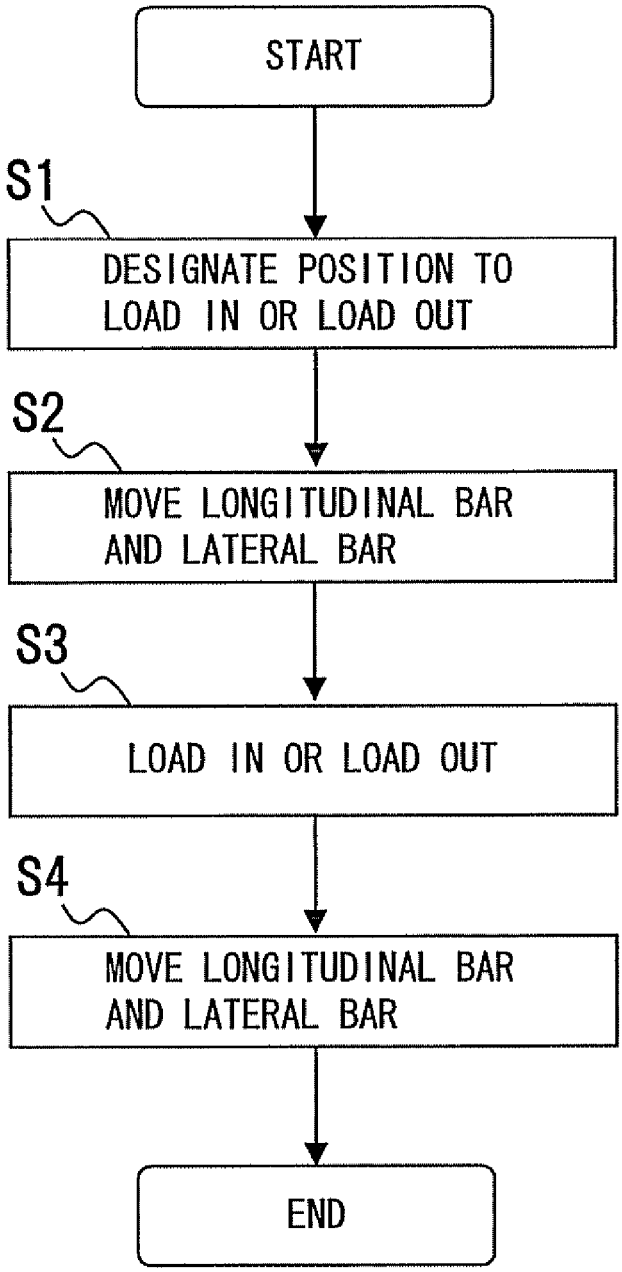
FIG. 9 is a flowchart of an example of a cartridge protecting method.

Description will be given for the protection, and loading in and loading out of the cartridge referring to FIGS. 8A, 8B, and 9. FIGS. 8A and 8B depict opening and closing of the accommodating shelf, and FIG. 8A depicts the closed state and FIG. 8B depicts the opened state. FIG. 9 depicts a flowchart showing an example of a cartridge protecting method. In FIGS. 8A and 8B, the same components as those of FIGS. 1, 2, and 3 are given the same reference numbers.

As depicted in FIG. 8A, when each of the longitudinal bars BV1, BV2, BV3, BV4, and BV5, and the lateral bars BL1, BL2, BL3, BL4, and BL5 is moved to the closed position thereof, the entrance/exit portion 10 of each cell C of the accommodating shelf 6 is obstructed by each of the longitudinal bars BV1, BV2, BV3, BV4, and BV5, and the lateral bars BL1, BL2, BL3, BL4, and BL5, and loading in and loading out the cartridge 4 are prohibited. Due to this guard of the security guard mechanism unit 8, the cartridge 4 can be protected from falling off caused by vibration and theft.

When the cell C33 is designated, for example, as a position to load in or load out the cartridge 4 in this guarding state, the longitudinal bar BV3 and the lateral bar BL3 are designated to be moved. When the longitudinal bar BV3 is moved from the closed position thereof to the opened position thereof (arrow X) and the lateral bar BL3 is moved from the closed position to the opened position (arrow Y) as depicted in FIG. 8B, only the entrance/exit portion 10 of the cell C33 is opened and the cartridge 4 can be loaded in or loaded out of the cell C33.

As depicted in FIG. 9, for the loading in and the loading out of the cartridge, a position for loading in or loading out of the cartridge 4 is designated (step S1). In this designation of the position, the position of a cell C at "m"th line and "n"th column is designated. A longitudinal bar BV and a lateral bar BL each corresponding to the designated position are each moved from a closed position to an opened position (step S2). Due to the move of the longitudinal bar BV and the lateral bar BL to the opened position, the entrance/exit portion 10 of the designated cell C is brought into the opened state thereof. At this time, loading in or loading out the cartridge 4 can be executed (step S3). After this loading in or loading out, by moving the longitudinal bar BV and the lateral bar BL to the closed position (step S4), the entrance/exit portion 10 of the cell C is brought into the closed state thereof.

In this case, even when the longitudinal bar BV3 has been moved to the opened position, the lateral bar BL1 is at the closed position for a cell C31; the lateral bar BL2 is at the closed position for a cell C32; the lateral bar BL4 is at the closed position for a cell C34; and the lateral bar BL5 is at the closed position for a cell C35. Therefore, the cartridge 4 can not be put in and taken out of each of the cells C31, C32, C34, and C35. Even when the lateral bar BL3 has been moved to the opened position, the longitudinal bar BV1 is at the closed position for a cell C13; the longitudinal bar BV2 is at the closed position for a cell C23; the longitudinal bar BV4 is at the closed position for a cell C43; and the longitudinal bar BV5 is at the closed position for a cell C53. Therefore, the cartridge 4 can not be put in and taken out of each of the cells C13, C23, C43, and C53. During the putting in and taking out of the cartridge 4 for the cell C33, the cartridges 4 present in other cells C are protected from falling off, theft, etc.

In this manner, putting in and taking out of the cartridges 4 for the cells C are limited by the longitudinal bars BV1, BV2, BV3, BV4, and BV5, and the lateral bars BL1, BL2, BL3, BL4, and BL5, and the position of a specific (single) cell C to be loaded in and loaded out of can be designated by designating any of the longitudinal bars BV1, BV2, BV3, BV4, and BV5, and any of the lateral bars BL1, BL2, BL3, BL4, and BL5. Thereby, the cartridge 4 can be loaded in and loaded out of the cell C.

As above, according to the cartridge protecting apparatus or the cartridge protecting method, falling off of the cartridge(s) 4 accommodated in one or more cell (s) C of the accommodating shelf 6 can be prevented from, only the cartridge 4 in the cell C at a designated position can be loaded in and loaded out, and the cartridges 4 that are accommodated items can be protected.

Second Embodiment

Figure 10:
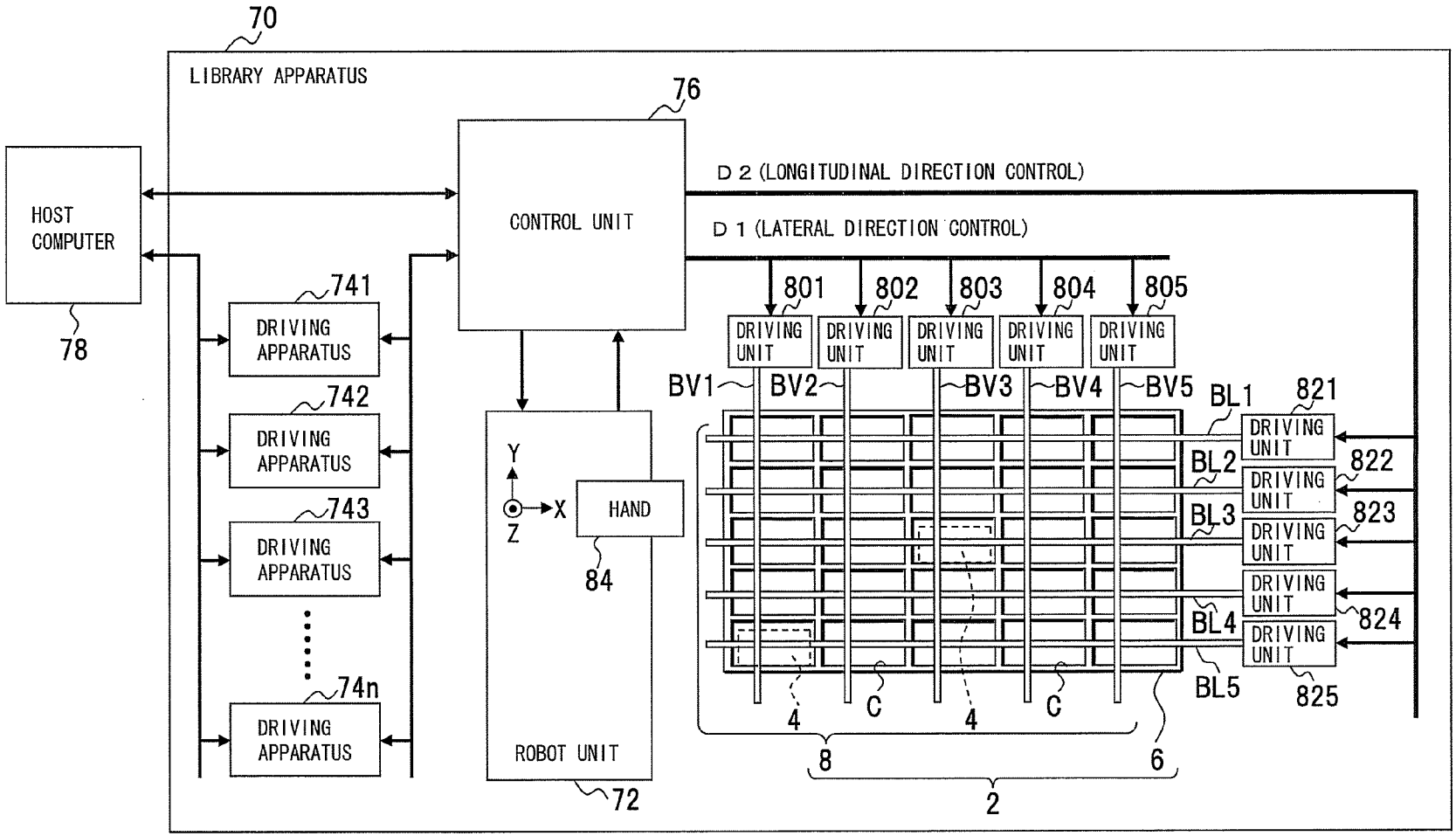
FIG. 10 depicts an exemplary structure of a library apparatus according to a second embodiment.
Figure 11:
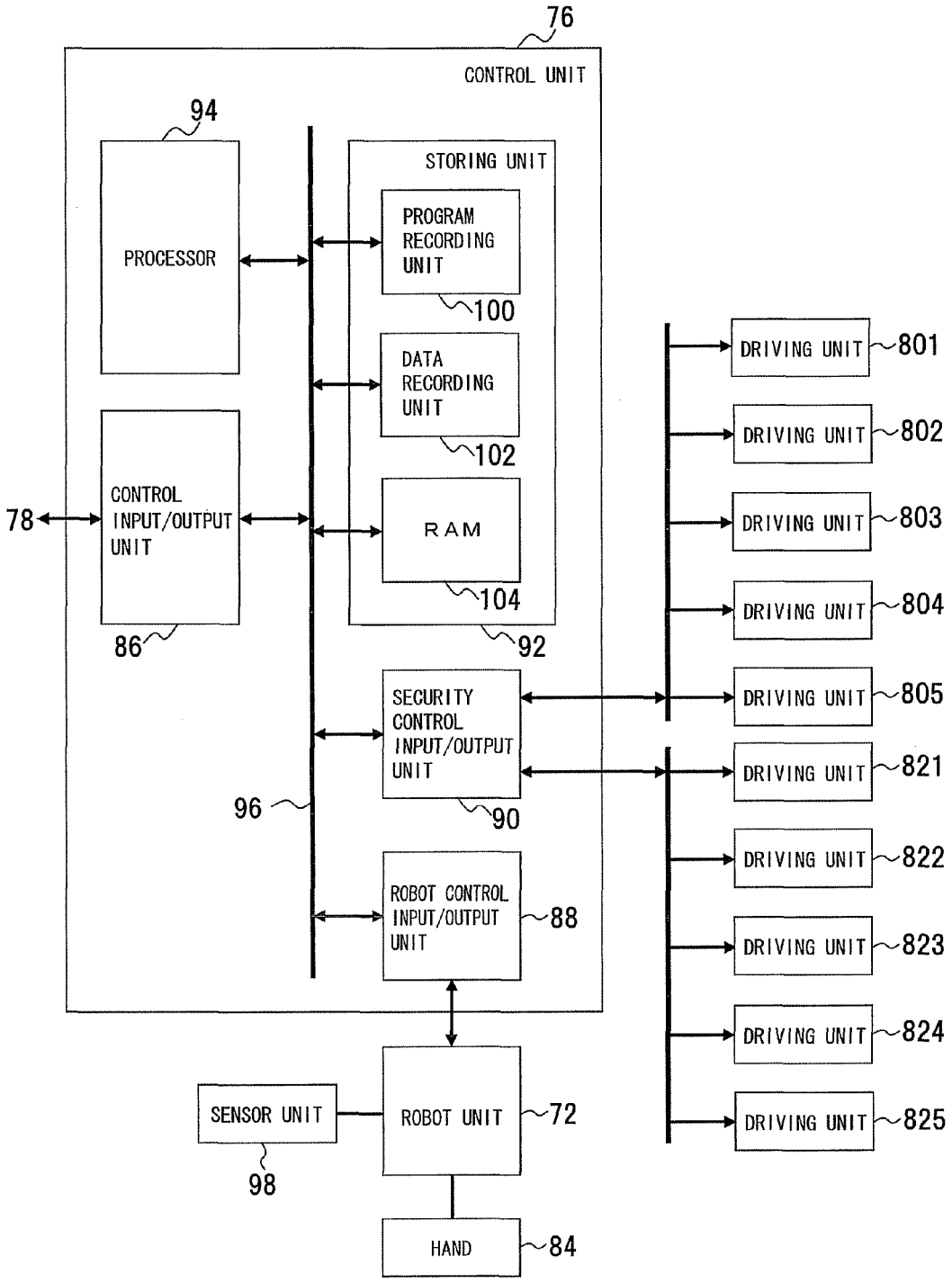
FIG. 11 depicts an exemplary structure of a control unit.

Description will be given for a second embodiment of the present invention referring to FIGS. 10 and 11. FIG. 10 depicts an exemplary structure of a library apparatus. FIG. 11 depicts a block diagram of an exemplary structure of a control unit. In FIGS. 10 and 11, the same components as those of FIGS. 1 to 3 are given the same reference numbers.

This library apparatus 70 is an example of the protecting apparatus or the protecting method of accommodated items; includes the above cartridge protecting apparatus 2; protects the cartridges 4 from falling off the accommodating shelf 6 and theft; includes a robot unit 72, a plurality of driving apparatuses 741, 742, . . . , and 74*n*, and a control unit 76; and can load in and load out the cartridges 4 to/of the accommodating shelf 6 and read and write data according to control of a host computer 78 that is an upper apparatus.

The security guard mechanism unit 8 of the cartridge protecting apparatus 2 is disposed with driving units 801, 802, 803, 804, and 805 to respectively move in parallel the longitudinal bars BV1, BV2, BV3, BV4, and BV5 individually in the horizontal direction and driving units 821, 822, 823, 824, and 825 to respectively move in parallel the lateral bars BL1, BL2, BL3, BL4, and BL5 individually in the vertical direction. Each of the driving units 801, 802, 803, 804, and 805 receives a control output D1 that the control unit 76 outputs, converts the control output D1 into a driving force in the horizontal direction, and drives a corresponding one of the longitudinal bars BV1, BV2, BV3, BV4, and BV5. Each of the driving units 821, 822, 823, 824, and 825 receives a control output D2 that the control unit 76 outputs, converts the control output D2 into a driving force in the vertical direction, and drives a corresponding one of the lateral bars BL1, BL2, BL3, BL4, and BL5. Each of the driving units 801, 802, 803, 804, and 805 supports a corresponding one of the longitudinal bars BV1, BV2, BV3, BV4, and BV5 such that these bars can be moved in parallel in the horizontal direction; and may be configured by a movable mechanism, a motor supplying a driving force to the mechanism, a solenoid, a pneumatic pump, etc. Similarly, each of the driving units 821, 822, 823, 824, and 825 supports a corresponding one of the longitudinal bars BL1, BL2, BL3, BL4, and BL5 such that these bars can be moved in parallel in the vertical direction; and may be configured by a movable mechanism, a motor supplying a driving force to the mechanism, a solenoid, a pneumatic pump, etc.

The robot unit 72 is a conveying unit that conveys the cartridge; includes a hand 84 that is a gripping unit that grips the cartridge 4; and, according to control of the control unit 76 that has received an instruction of the host computer 78, controls gripping and releasing the cartridge 4 by the hand 84, move to a designated one of the driving apparatuses 741, 742, . . . , and 74*n*, attachment and detachment of the cartridge 4, loading in and loading out the cartridge 4 to/of a cell C at a designated position on the accommodating shelf 6, etc. The hand 84 is manipulated in X, Y, and Z-axis directions by the robot unit 72.

The driving apparatuses 741, 742, . . . , and 74*n* execute data processing such as writing, reading, and deleting of data to/from/in the recording medium of the attached cartridge 4 according to the control of the host computer 78.

The control unit 76 is controlled by the host computer 78 and executes control of the robot unit 72 and control of the driving apparatuses 741, 742, . . . , and 74*n*. Describing generally the control unit 76, for example, as depicted in FIG. 11, the control unit 76 includes a control input/output unit 86, a robot control input/output unit 88, a security control input/output unit 90, a storing unit 92, and a processor 94, and these components are connected by a bus 96.

The control input/output unit 86 inputs and outputs control information from/to the host computer 78 according to control of the processor 94 and, for example, executes designation of a cartridge 4 to/from which data is written or read. In the case where the cartridge 4 is designated, when the cartridge 4 is present, the accommodating position thereof is identified by the control unit 76. When a new cartridge 4 is put in, the accommodating position thereof is recorded in the storing unit 92.

According to control of the processor 94, the robot control input/output unit 88 provides a control output to the robot unit 72 and moves the hand 84 to a predetermined cell position of the driving apparatuses 741, 742, . . . , and 74*n* or of the accommodating shelf 6. In this case, position information of the robot unit 72 and the hand 84 is captured and stored from a sensor unit 98 of the robot unit 72 into the storing unit 92 through the robot control input/output unit 88. The sensor unit 98 is configured including a tachometer that detects rotations from rotating units such as motors disposed in mechanism units of the robot unit 72 and the hand 84, and may be configured to obtain the position information by detecting the rotations.

According to control of the processor 94, the security control input/output unit 90 outputs the driving output corresponding to the cell position to be opened or closed to the driving units 801, 802, 803, 804, 805, 821, 822, 823, 824, and 825 and, thereby, only the entrance/exit portion 10 of the cell C at the predetermined position is controlled to be in the opened state thereof. This opened state is identified by the position information of the sensor unit 98 of the above robot unit 72.

The storing unit 92 is configured by a recording medium that stores various types of information, and includes a program recording unit 100, a data recording unit 102, a RAM (Random Access Memory) 104, etc. The program recording unit 100 is configured by a hard disc storing apparatus, etc., and stores an OS (Operating System), a cartridge protecting program that controls the cartridge protecting apparatus 2, a robot control program that controls the robot, a drive control program that controls the driving apparatuses 741, 742, . . . , and 74*n*, etc. The data recording unit 102 stores various types of data such as various types of data that are provided and received to/from the host computer 78, control data of the robot unit 72, and position data from the robot unit 72. The RAM (Random Access Memory) 104 expands programs such as the OS, the cartridge protecting program, the robot control program, and the drive control program, and constitutes work areas for various controls.

According to the above library apparatus 70, because of including the cartridge protecting apparatus 2, as described for the first embodiment, falling off of the cartridge(s) 4 accommodated in the one or more cell(s) C of the accommodating shelf 6 can be prevented, only the cartridge 4 in the cell C at a designated position can be loaded in or loaded out, and the cartridge 4 that is an accommodated item can be protected from falling off caused by vibration and theft. In the opened state, the longitudinal bar BV and the lateral bar BL retreat to the spaces on the thickness of the partitioning wall portions 60 and 62 each partitioning a cell C off another cell C, setting the spaces to be stand-by places. Therefore, these bars do not interfere the loading in or loading out of the cartridge 4 by the hand 84 to/from the entrance/exit portion 10.

Figure 12:
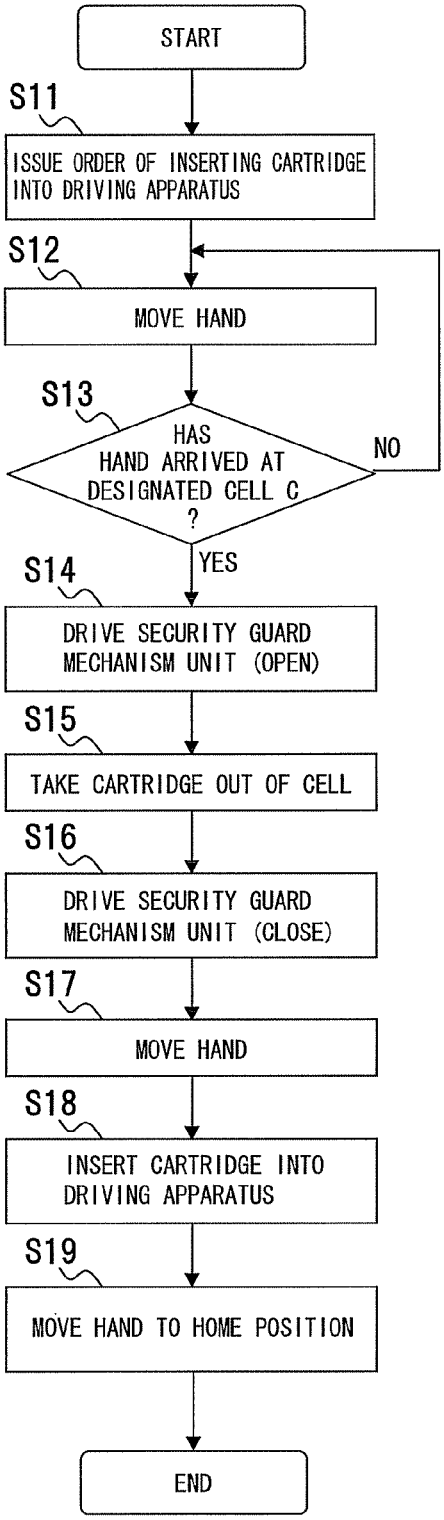
FIG. 12 is a flowchart of the process procedure of loading out a cartridge of a cell and protection thereof.

Description will be given for the loading out and protection of the cartridge 4 of the library apparatus 70 referring to FIG. 12. FIG. 12 depicts a flowchart of the process procedure of a loading-out operation of a cartridge from a cell.

The process procedure is an example of the cartridge protecting method, the cartridge protecting program, the robot control program, and the drive control program, and represents the procedure from taking out the cartridge 4 from the cell C to inserting the cartridge 4 into any of the driving apparatuses 741, 742, . . . , and 74*n*.

In this case, an order for the cartridge 4 to be inserted is issued to, for example, the driving apparatus 741 of the driving apparatuses 741, 742, . . . , and 74*n* (step S11). The hand 84 of the robot unit 72, that is standing-by at a home position is moved to the position of the designated cell C that accommodates the cartridge 4 (step S12).

During the move of the hand 84, the move of the hand 84 is monitored until the hand 84 arrives at the designated cell C and, thereby, whether the hand 84 has arrived at the designated cell C is determined (step S13). This determination is executed by referring to the above position information. When the hand 84 has arrived at the designated cell C (YES of step S13), the longitudinal bar BV and the lateral bar BL of the security guard mechanism unit 8 that obstruct the designated cell C are designated and moved and, thereby, the entrance/exit portion 10 of the designated cell C is controlled to be brought into the opened state thereof (step S14).

The cartridge 4 is taken out of the opened cell C (step S15). When this taking out has been completed, the longitudinal bar BV and the lateral bar BL of the security guard mechanism unit 8 are returned to the closed positions for the entrance/exit portion 10 of the cell C and the entrance/exit portion 10 is controlled to be brought into the closed state thereof (step S16).

The hand 84 that is gripping the cartridge 4 is moved (step S17) and the cartridge 4 is conveyed to the designated driving apparatus 741 and is inserted thereinto (step S18). When this insertion has been completed, the hand 84 is moved restoring the home position thereof (step S19) and this process is completed.

In this manner, in the library apparatus 70, until the hand 84 arrives at the designated cell C and the cartridge 4 can be loaded out by the hand 84, the cartridge 4 in the designated cell C is put in the closed state and, therefore, the cartridge 4 can be protected by the cartridge protecting apparatus 2 from falling off caused by vibration and theft.

Figure 13:
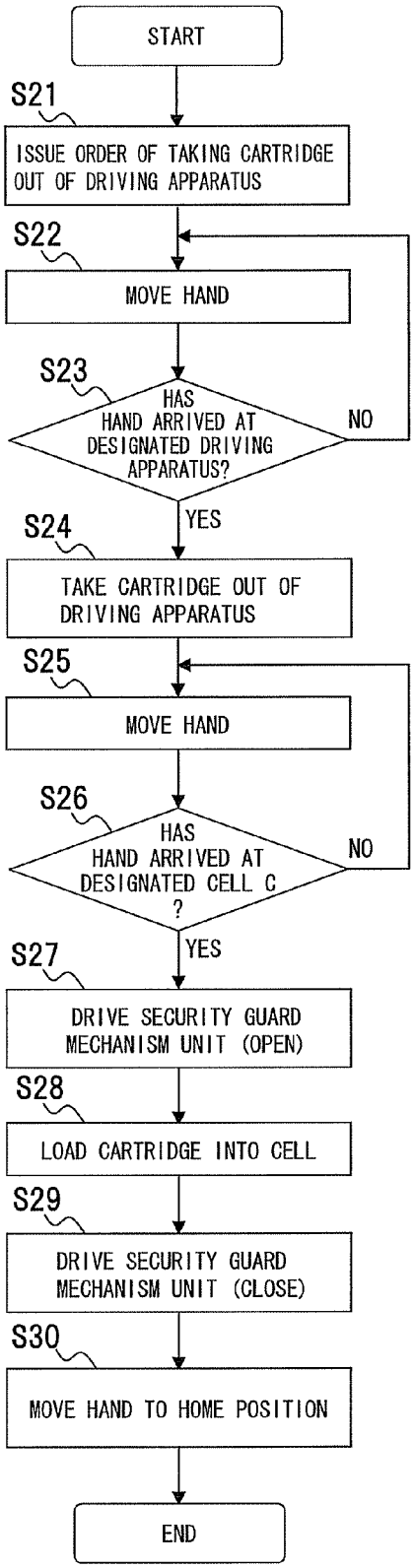
FIG. 13 is a flowchart of the process procedure of loading in a cartridge to a cell and protection thereof.

Description will be given for loading in and protection of the cartridge 4 of the library apparatus 70 referring to FIG. 13. FIG. 13 depicts a flowchart of the process procedure of a loading-in operation of a cartridge to a cell.

The process procedure is an example of the cartridge protecting method, the cartridge protecting program, the robot control program, and the drive control program, and represents the procedure from taking out the cartridge 4 from any of the driving apparatuses 741, 742, . . . , and 74*n* to loading the cartridge 4 into any of the cells C.

Now, assuming that the cartridge 4 is inserted into the driving apparatus 741, an order for the cartridge 4 to be taken out is issued (step S21). The hand 84 of the robot unit 72 that is standing-by at the home position is moved to the driving apparatus 741 accommodating the designated cartridge 4 (step S22).

During the move of the hand 84, the move of the hand 84 is monitored until the hand 84 arrives at the designated driving apparatus 741 and, thereby, whether the hand 84 has arrived at the driving apparatus 741 is determined (step S23). That this determination is executed by referring to the above position information is similar to that of the above process. When the hand 84 has arrived at the designated driving apparatus 741 (YES of step S23), the cartridge 4 is taken out from the driving apparatus 741 (step S24) and the hand 84 gripping the cartridge 4 is moved toward the designated cell C (step S25).

During the move of the hand 84, the move of the hand 84 is monitored until the hand 84 arrives at the designated cell C and, thereby, whether the hand 84 has arrived at the designated cell C is determined (step S26). When the hand 84 has arrived at the designated cell C (YES of step S26), the longitudinal bar BV and the lateral bar BL of the security guard mechanism unit 8 that obstruct the designated cell C are designated and moved and, thereby, the entrance/exit portion 10 of the designated cell C is controlled to be brought into the opened state thereof (step S27).

The cartridge 4 is loaded in the opened cell C (step S28). When this loading-in has been completed, the longitudinal bar BV and the lateral bar BL of the security guard mechanism unit 8 are returned to the closed positions thereof for the entrance/exit portion 10 of the cell C and the entrance/exit portion 10 is controlled to be brought into the closed state thereof (step S29).

When the cell C into which the cartridge 4 has been loaded has been brought into the closed state thereof, the hand 84 is moved restoring the home position thereof (step S30) and this process is completed.

In this manner, in the library apparatus 70, after the hand 84 has arrived at the designated cell C and the loading in of the cartridge 4 by the hand 84 has been completed, the cell C is brought into the closed state thereof and, therefore, the cartridge 4 having been loaded into the cell C is protected from falling off caused by vibration and theft.

Figure 14A:
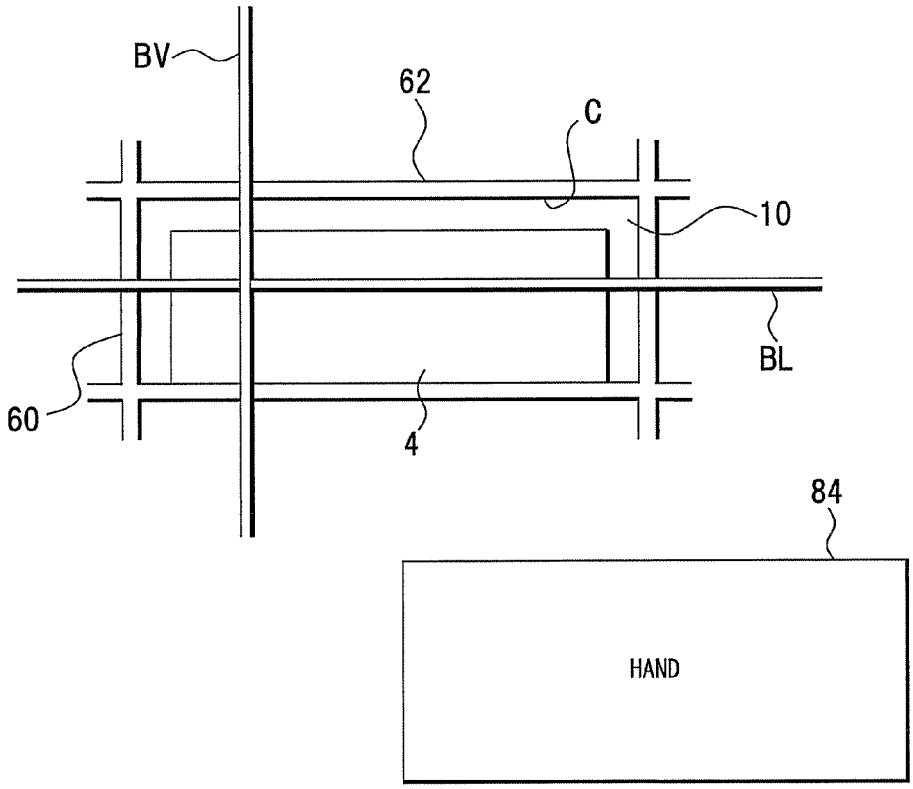
FIGS. 14A and 14B depict an exemplary structure that uses a security guard mechanism unit and a hand for a cartridge protecting apparatus.

Description will be given for the timing to open the security guard mechanism unit 8 referring to FIGS. 14A, 14B, 15A, and 15B. FIGS. 14A, 14B, 15A, and 15B each depict the position of the hand 84 and the timing to open the cell C. FIGS. 14A and 15A each depict the state before the opening and FIGS. 14B and 15B each depict the opened state. In FIGS. 14A, 14B, 15A, and 15B, the same components as those of FIGS. 1 to 4 are given the same reference numbers.

Because the library apparatus 70 includes the hand 84 that is controlled by the robot unit 72, when the entrance/exit portion 10 of the cell C is obstructed by the hand 84 and the security guard mechanism unit 8 is controlled at the timing at which the cartridge 4 can not be loaded in and loaded out by any member other than the hand 84, the cartridge 4 can be protected from falling off caused by vibration, theft, etc., even while the robot unit 72 is being driven.

As depicted in FIGS. 14A and 15A, when the hand 84 is present that is moving or stopping outside the range of the entrance/exit portion 10 of the designated cell C, the longitudinal bar BV and the lateral bar BL are maintained in the closed state thereof. By doing this, the cartridge 4 can be protected from falling off caused by vibration, theft, etc., while the robot unit 72 is being driven.

Figure 14B:
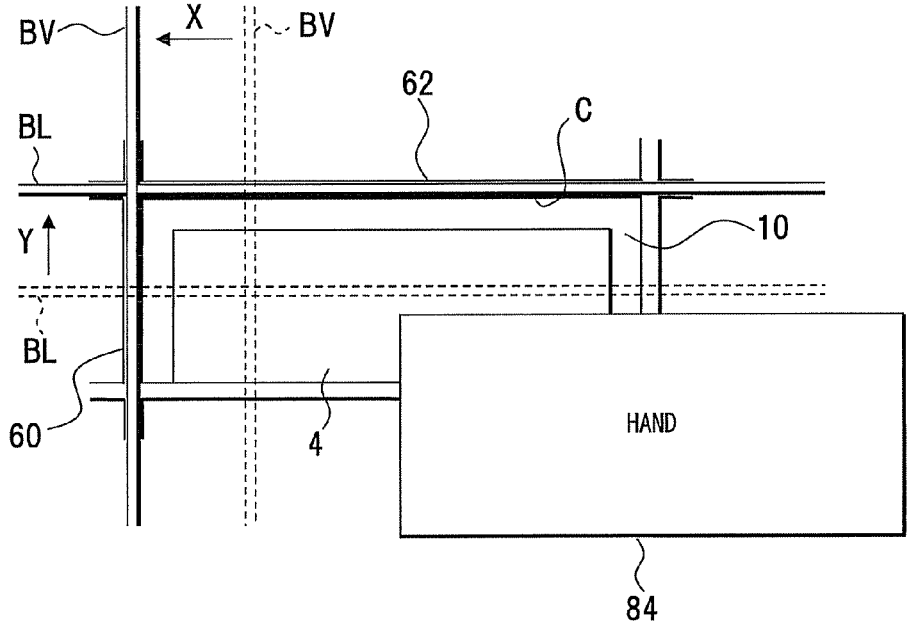
Figure 15A:
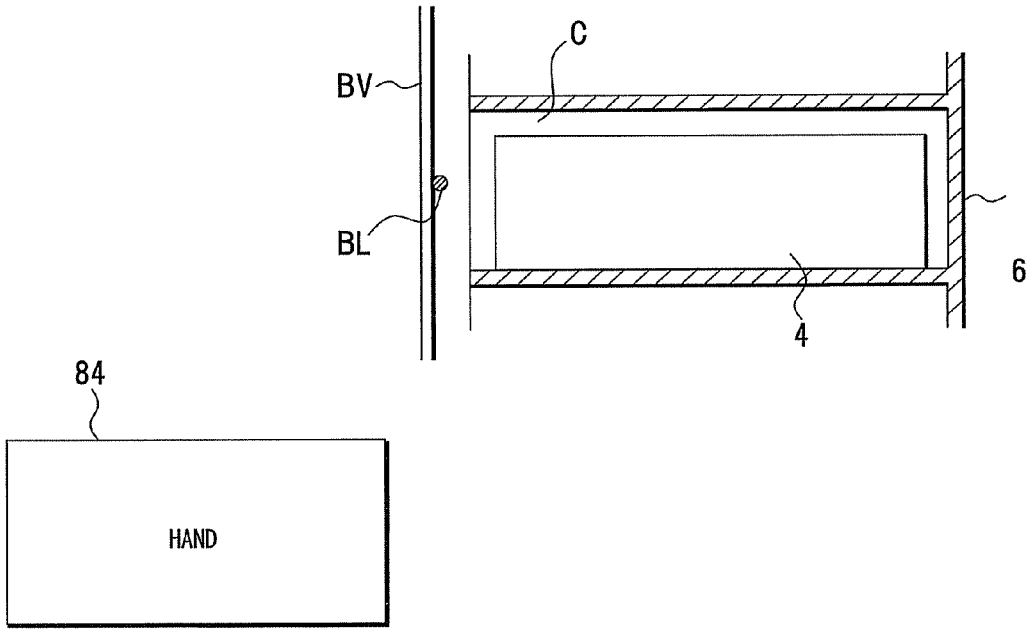
FIGS. 15A and 15B depict another exemplary structure that uses a security guard mechanism unit and a hand for a cartridge protecting apparatus.
Figure 15B:
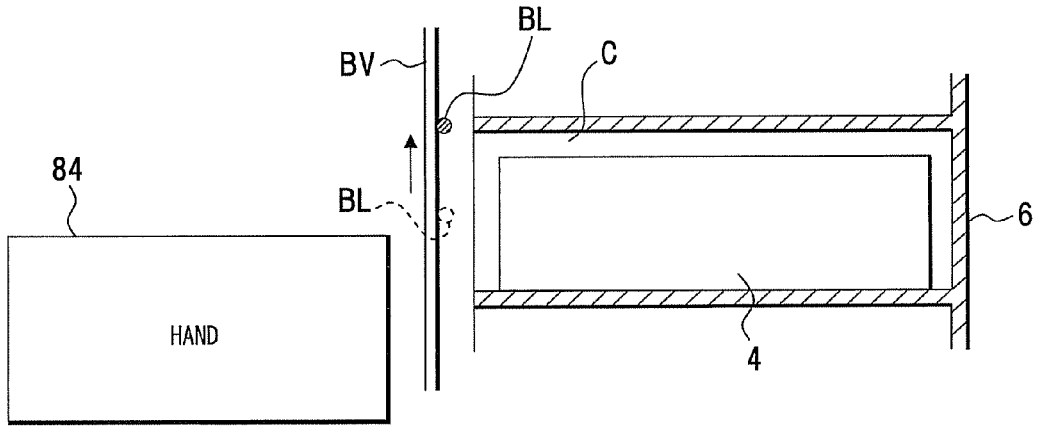

As depicted in FIGS. 14B and 15B, in the case where the hand 84 has arrived within the range of the entrance/exit portion 10 of the designated cell C, when the longitudinal bar BV and the lateral bar BL are controlled to be at the opened positions from the closed positions, the hand 84 can protect the cartridge 4 in the cell C from falling off caused by vibration, theft, etc., because the hand 84 obstructs fully or partially the entrance/exit portion 10 of the cell C. That is, the cartridge 4 can also be protected from falling off caused by vibration, theft, etc., because no member other than the hand 84 can not take out the cartridge 4.

As to the creation of the timing to open the security guard mechanism unit 8, the moment when the hand 84 has arrived in the range from which the hand 84 can not take out the cartridge 4 from the entrance/exit portion 10 of the designated cell C according to the position information obtained from the sensor unit 98 may be determined to be the timing to open the security guard mechanism unit 8.

Figure 16:
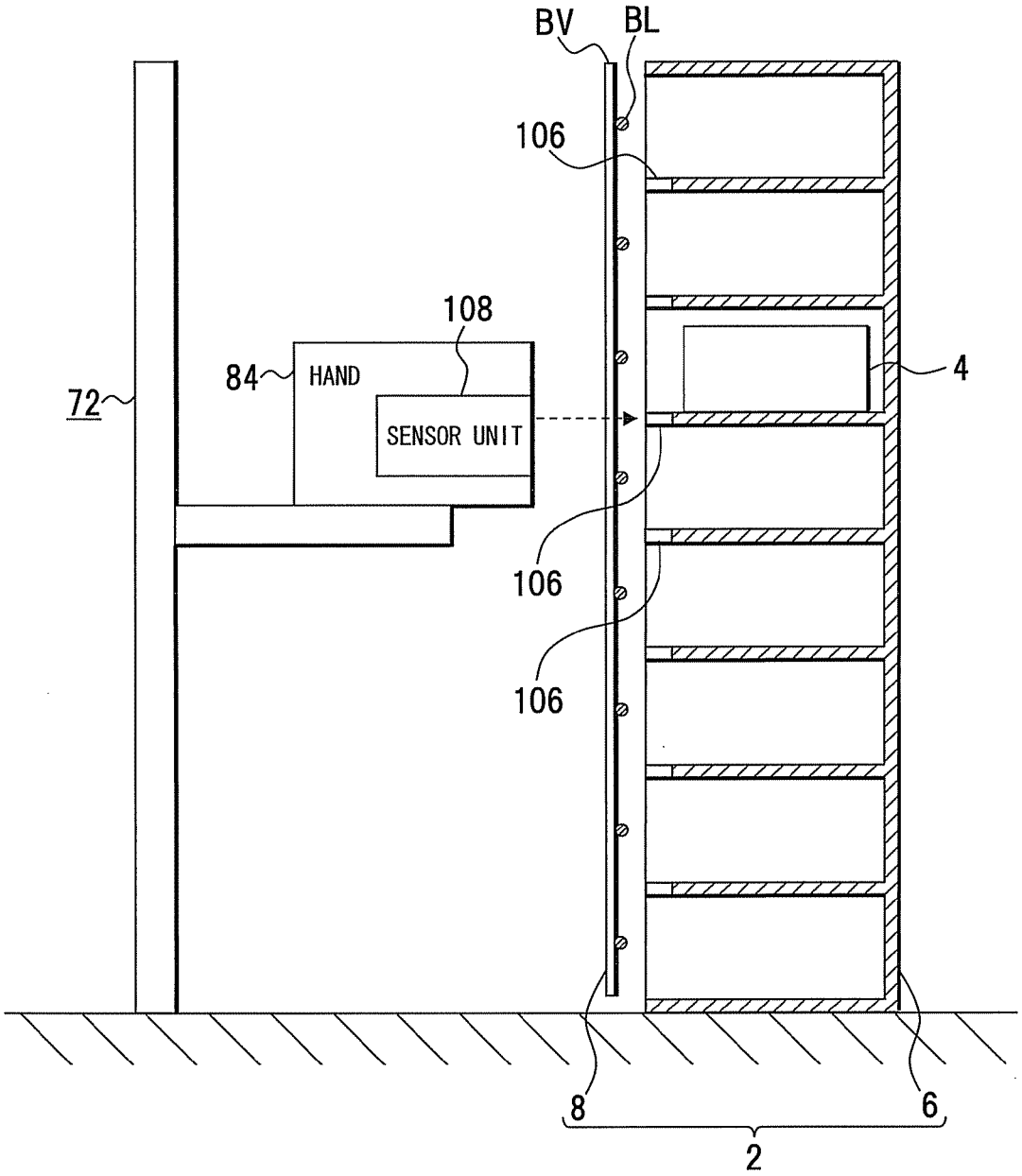
FIG. 16 depicts an exemplary structure that detects arrival of the hand to the position of a cell.

As to the creation of timing to open one of the other security guard mechanism units 8, as depicted in FIG. 16, in the case where each cell C includes a cell identifying unit 106 that indicates the position of the cell C, when a sensor unit 108 disposed on the hand 84 detects the cell identifying unit 106, the timing is preferably configured to be the time when the hand 84 arrives within the range from which the hand 84 can not take out the cartridge 4 from the entrance/exit portion 10 of the cell C. According to the above configuration, the cartridge 4 is also protected from falling off and theft by capturing the detection information into the control unit 76 and setting the time of the detection to be the timing to open the security guard mechanism unit 8.

Figure 17:
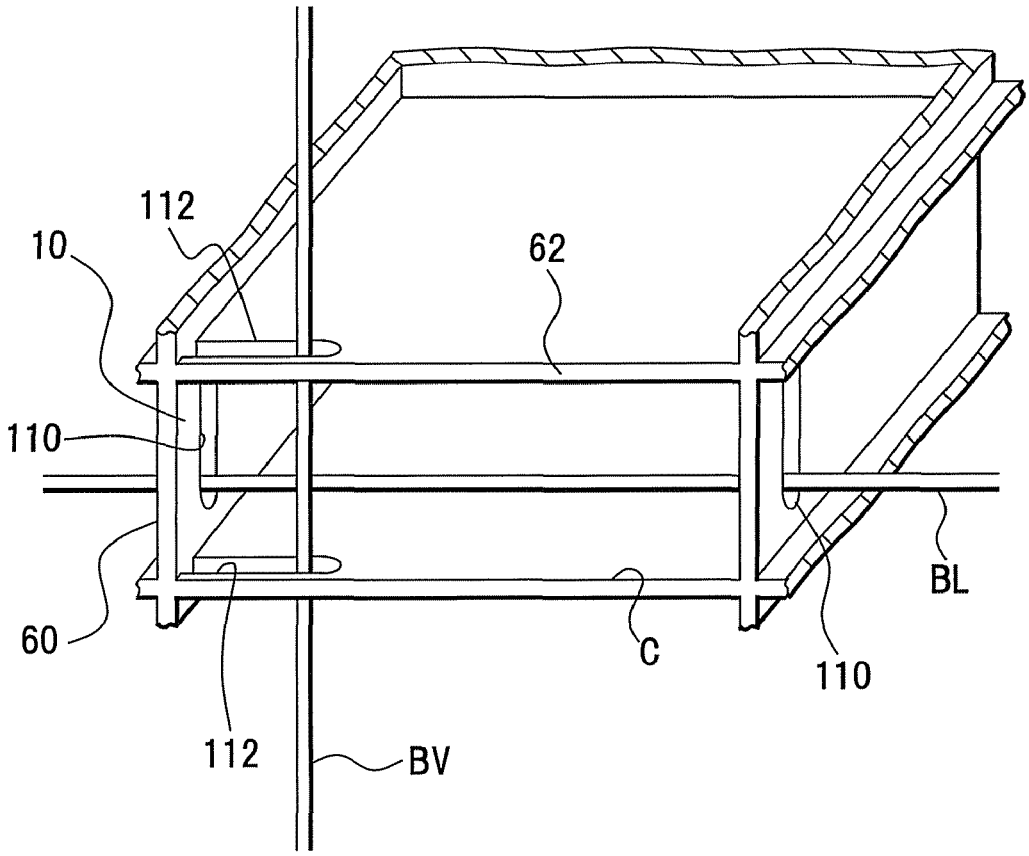
FIG. 17 depicts another exemplary structure of the security guard mechanism unit.

Other Embodiments (1) Though the security guard mechanism unit 8 is disposed in front of the entrance/exit portion 10 of each cell C in the above embodiments, the security guard mechanism unit 8 may be disposed, for example, on the entrance/exit portion 10 of each cell C as depicted in FIG. 17. In this case, the security guard mechanism unit 8 is preferably configured that a sliding hole 110 through which the lateral bar BL penetrates and moves is formed through the partitioning wall portion 60, and a sliding hole 112 through which the longitudinal bar BV penetrates and moves is formed through the partitioning wall portion 62 of the entrance/exit portion 10 of each cell C, and the lateral bar BL and the longitudinal bar BV are moved in the entrance/exit portion 10 of each cell C using these sliding holes 110 and 112. In this case, the longitudinal bar BV may be placed in the vicinity of the partitioning wall 60 or may be configured to be buried in the thickness of the partitioning wall 60. Similarly, the lateral bar BL may be placed in the vicinity of the partitioning wall 62 or may be configured to be buried in the thickness of the partitioning wall 62. According to this configuration, entering and exiting of the cartridge 4 through the entrance/exit portion 10 are not interfered.

Figure 18:
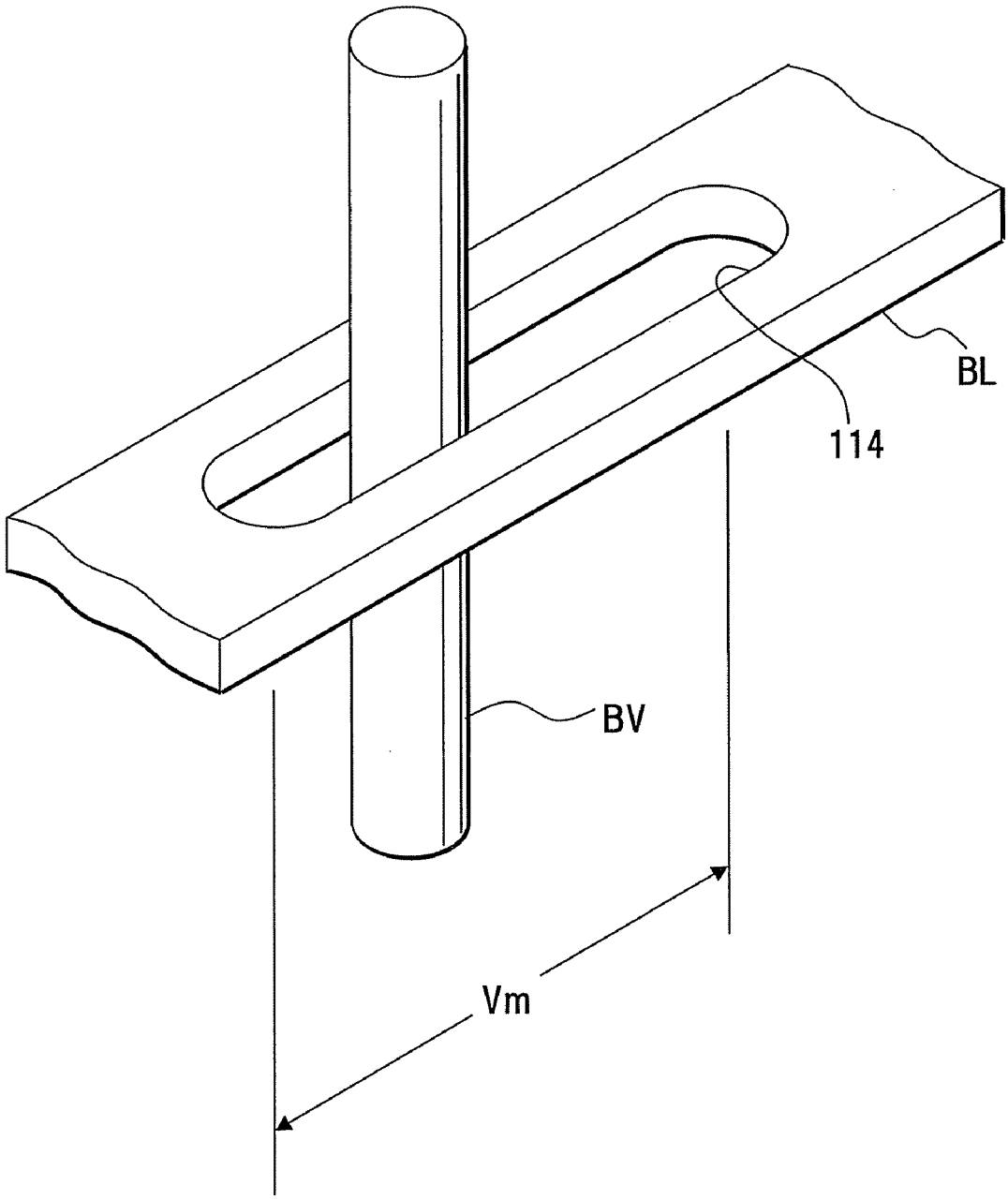
FIG. 18 depicts yet another exemplary structure of the security guard mechanism unit.

(2) Though the security guard mechanism unit 8 is configured to have the longitudinal bar BV and the lateral bar BL crossing each other in the above embodiments, this crossing portion may be configured, for example, as depicted in FIG. 18, to be formed with a penetrating portion 114 having a width of the moving range Vm of the longitudinal bar BV through the lateral bar BL, to penetrate the longitudinal bar BV through the penetrating portion 114, and to cross the longitudinal bar BV and the lateral bar BL each other. According to this configuration, the mechanical strength of the security guard mechanism unit 8 can be improved.

Figure 19:
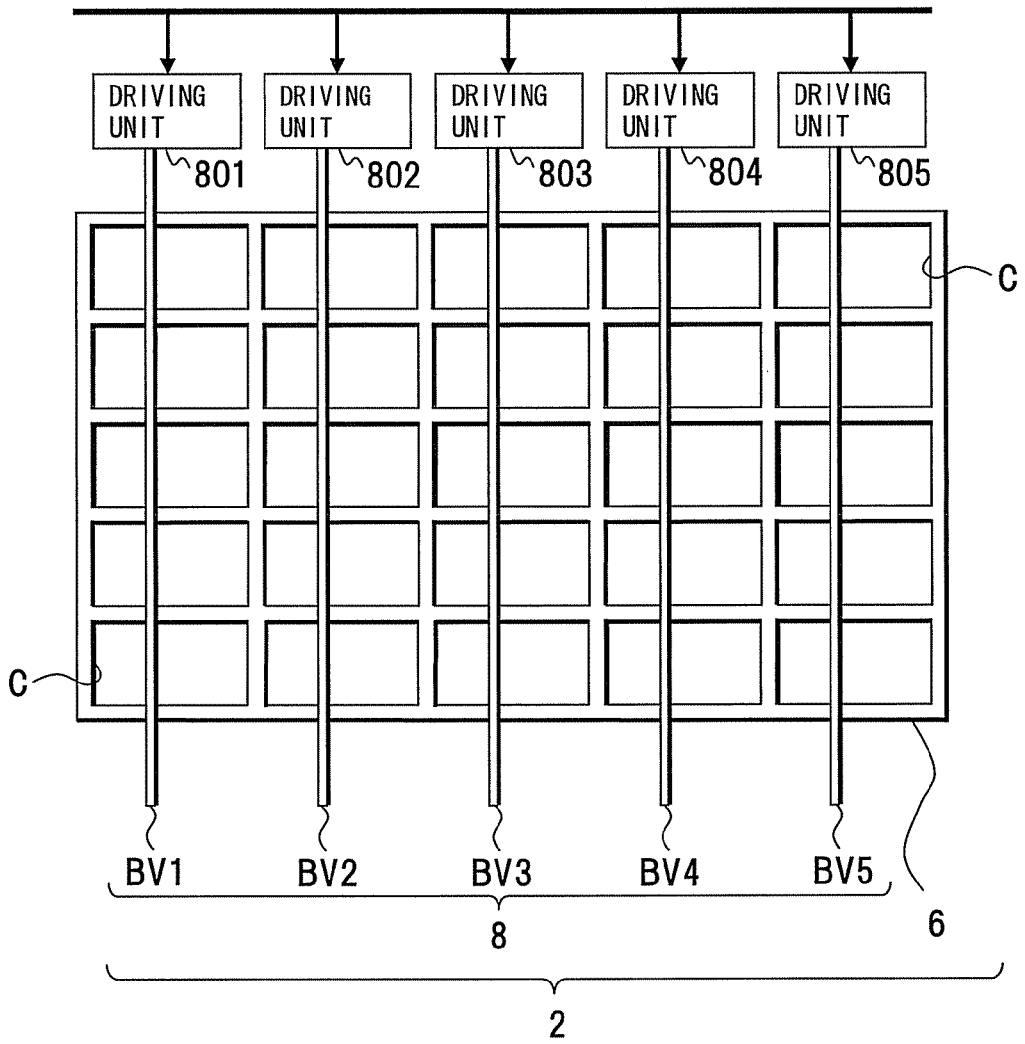
FIG. 19 depicts yet another exemplary structure of the security guard mechanism unit.

(3) Though the security guard mechanism unit 8 is configured by the longitudinal bars BV and the lateral bars BL in the above embodiments, the security guard mechanism unit 8 may be configured, as depicted in FIG. 19, only by the longitudinal bars BV. According to this configuration, when any of the longitudinal bars BV1, BV2, . . . , and BV5 is moved to the opened position thereof, the cartridges 4 corresponding to the number of cells in the longitudinal direction are victimized, however, the number of victimized cartridges 4 can be minimized.

Figure 20:
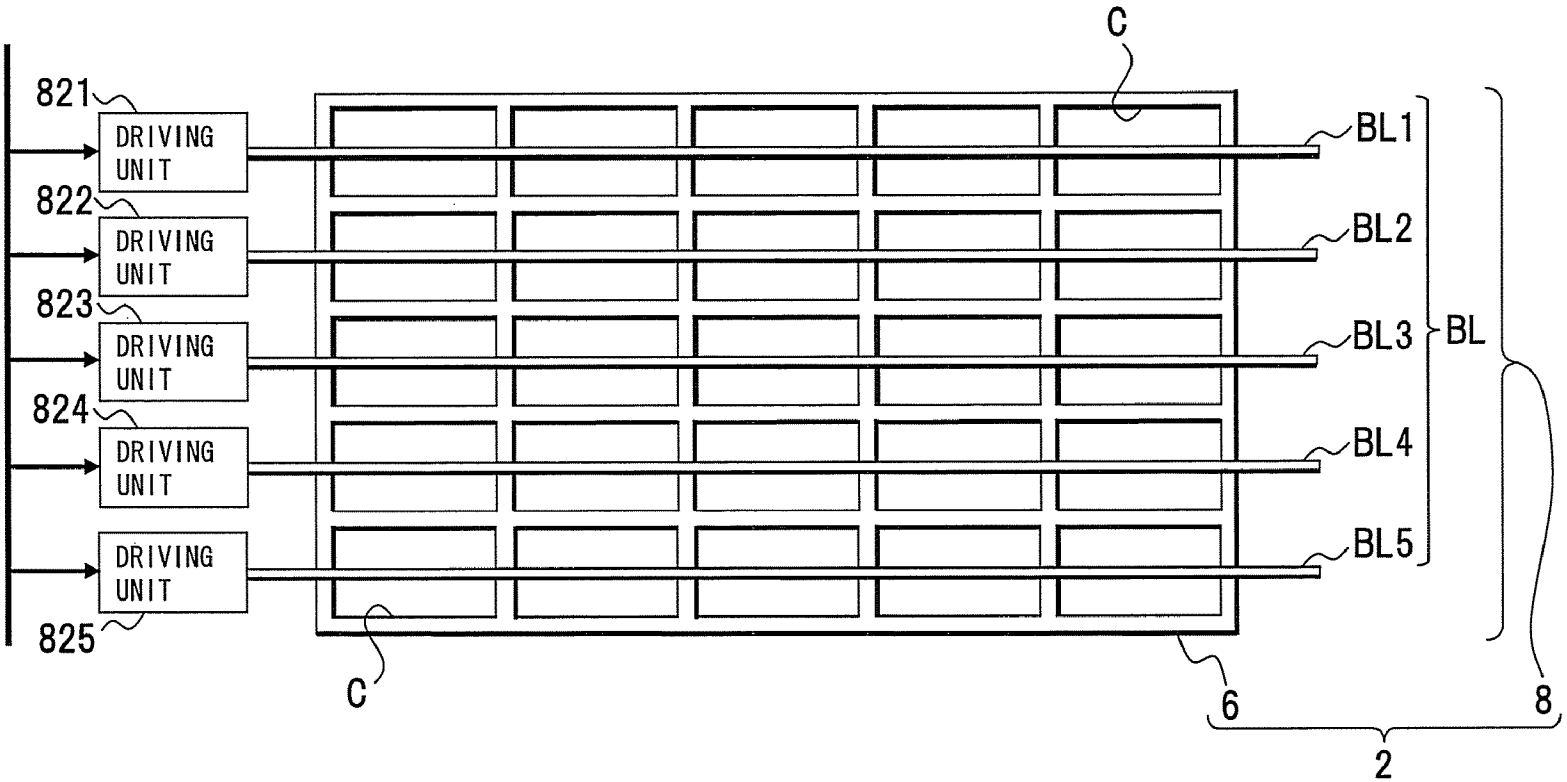
FIG. 20 depicts yet another exemplary structure of the security guard mechanism unit.

(4) Though the security guard mechanism unit 8 is configured by the longitudinal bars BV and the lateral bars BL in the above embodiments, the security guard mechanism 8 may be configured, as depicted in FIG. 20, only by the lateral bars BL. According to this configuration, when any of the lateral bars BL1, BL2, . . . , and BL5 is moved to the opened position thereof, the number of victimized cartridges 4 can be minimized to the extent the cartridges 4 corresponding to the number of cells in the lateral direction are victimized.

(5) Though the cartridges 4 are exemplified as the accommodated items in the above embodiments, the present invention can protect accommodated items from falling off and theft from a repository or a show case that accommodates accommodated items other than the cartridges 4, and the accommodated items of the present invention are not limited to cartridges.

Though the most preferred embodiments, etc., of the present invention have been described as above, the present invention is not limited to the above and those skilled in the art can surely make various modifications or changes thereto based on the gist described in claims or disclosed herein. The modifications and the changes are surely included in the scope of the present invention.

The present invention relates to protection of accommodated items accommodated in an accommodating shelf into/out of which accommodated items such as cartridges each incorporating recording media such as magnetic tapes can be put in/taken. The present invention includes a structure that enables loading in or loading out of the accommodated items by moving guard bars corresponding to a cell into/out of which the accommodated item is loaded, from a closed position to an opened position and, after the loading in or the loading out, that protects the accommodated item by moving the guard bars from the opened position to the closed position. Thereby, the protection is enabled by a simple structure and effects such as that the recording medium can omit an encrypting process, etc., can be expected and, therefore, the present invention is useful.

What is claimed is:

1. A protecting apparatus of items accommodated in an accommodating shelf into/out of which the accommodated items are put/taken, the protecting apparatus comprising:

a plurality of cells, which are arranged in longitudinal direction and lateral direction, accommodating the accommodated items, each of the cells having an entrance/exit portion to put/take the accommodated items;

a plurality of longitudinal bars disposed across the entrance/exit portions of the cells which are arranged in the longitudinal direction;

a plurality of lateral bars disposed across the entrance/exit portions of the cells which are arranged in the lateral direction;

a plurality of first drivers configured to move the longitudinal bars individually in the lateral direction to allow individual entrance/exit portions to be blocked and unblocked; and a plurality of second drivers configured to move the lateral bars individually in the longitudinal direction to allow individual entrance/exit portions to be blocked and unblocked, wherein a longitudinal bar disposed in front of an entrance/exit portion of a specific cell selected from the cells is moved individually in the lateral direction and a lateral bar disposed in front of an entrance/exit portion of the specific cell is moved individually in the longitudinal direction to the outside of the entrance/exit portion of the specific cell, respectively, to allow an entrance/exit portion of the specific cell to be unblocked, wherein each entrance/exit portion of first cells forming a line with the specific cell in the longitudinal direction is blocked by each lateral bar disposed in front of the entrance/exit portions of the first cells though the moved longitudinal bar allows the entrance/exit portions of the first cells to be unblocked, and each entrance/exit portion of second cells forming a line with the specific cell in the lateral direction is blocked by each longitudinal bar disposed in front of the entrance/exit portions of the second cells though the moved lateral bar allows the entrance/exit portions of the second cells to be unblocked.

2. The protecting apparatus of accommodated items of claim 1, wherein the longitudinal bar and the lateral bar are disposed crossing each other on the entrance/exit portion.

3. The protecting apparatus of accommodated items of claim 1, wherein the longitudinal bar and the lateral bar are disposed in a matrix each spanning over the entrance/exit portions of the cells that are disposed in a matrix.

4. The protecting apparatus of accommodated items of claim 1, wherein the longitudinal bars obstruct in the longitudinal direction the entrance/exit portions of or the front of the entrance/exit portions of the plurality of cells each accommodating the accommodated item and the lateral bars obstruct in the lateral direction the entrance/exit portions of or the front of the entrance/exit portions of the plurality of cells, and wherein the specific cell, into/out of which the accommodated item is loaded, is selected using the longitudinal bars and the lateral bars.

5. The protecting apparatus of accommodated items of claim 1, further comprising:

a conveying unit configured to load the accommodated item into/out of the cell, wherein in case where putting in/taking out of the accommodated item through the entrance/exit portion of the specific cell is obstructed by the conveying unit, the longitudinal bar and the lateral bar which cross at the specific cell are moved to thea partitioning wall of the specific cell or in the vicinity thereof.

6. The protecting apparatus of accommodated items of claim 1, further comprising:

a conveying unit configured to load the accommodated item into/out of the cell, wherein in case where putting in/taking out of the accommodated item through the entrance/exit portion of the specific cell is obstructed by arrival of the conveying unit, the longitudinal bar and the lateral bar which cross at the specific cell are moved to thea partitioning wall of the specific cell or in the vicinity thereof at the timing of the arrival.

7. The protecting apparatus of accommodated items of claim 1, wherein both of the longitudinal bar and the lateral bar which cross at the specific cell are moved to a position that overlaps a partitioning wall of the specific cell.

8. A protecting method of items accommodated in an accommodating shelf into/out of which the accommodated items are put/taken, the protecting method comprising:

obstructing the putting/taking of the accommodated items into/out of a plurality of cells, which are arranged in longitudinal direction and lateral direction and accommodate the accommodated items, by a plurality of longitudinal bars and lateral bars, each of the cells having an entrance/exit portion to put/take the accommodated items, a plurality of the longitudinal bars being disposed across the entrance/exit portions of the cells which are arranged in the longitudinal direction and being movable individually in the lateral direction to allow individual entrance/exit portions by a plurality of first drivers to be blocked and unblocked, a plurality of the lateral bars being disposed across the entrance/exit portions of the cells which are arranged in the lateral direction and being movable individually in the longitudinal direction by a plurality of second drivers to allow individual entrance/exit portions to be blocked and unblocked;

individually moving a longitudinal bar disposed in front of an entrance/exit portion of a specific cell selected from the cells in the lateral direction and a lateral bar disposed in front of an entrance/exit portion of the specific cell in the longitudinal direction to the outside of the entrance/exit portion of the specific cell, respectively, to allow an entrance/exit portion of the specific cell to be unblocked in case where the accommodated item in the specific cell is loaded in or loaded out; and individually moving the longitudinal bar and the lateral bar to a position where to cross at the specific cell after the accommodated item is loaded in or loaded out, wherein each entrance/exit portion of first cells forming a line with the specific cell in the longitudinal direction is blocked by each lateral bar disposed in front of the entrance/exit portions of the first cells though the moved longitudinal bar allows the entrance/exit portions of the first cells to be unblocked, and each entrance/exit portion of second cells forming a line with the specific cell in the lateral direction is blocked by each longitudinal bar disposed in front of the entrance/exit portions of the second cells though the moved lateral bar allows the entrance/exit portions of the second cells to be unblocked.

9. The protecting method of accommodated items of claim 8, wherein the longitudinal bars obstruct in the longitudinal direction the entrance/exit portions of or the front of the entrance/exit portions of the plurality of cells each accommodating the accommodated item and the lateral bars obstruct in the lateral direction the entrance/exit portions of or the front of the entrance/exit portions of the plurality of cells, the method further comprising selecting a specific cell into/out of which the accommodated item is loaded, using the longitudinal bars and the lateral bars.

10. The protecting method of accommodated items of claim 8, further comprising:

obstructing the entrance/exit portion of the specific cell by a conveying unit that is configured to load the accommodated item into/out of the cell, wherein the longitudinal bar and the lateral bar which cross at the specific cell are moved in case where the conveying unit obstructs the entrance/exit portion of the specific cell and putting in/taking out of the accommodated item in the specific cell is obstructed.

11. The protecting method of accommodated items of claim 8, further comprising making a conveying unit configured to load the accommodated item into/out of the cell, arrive at the entrance/exit portion of the specific cell, wherein the longitudinal bar and the lateral bar which cross at the specific cell are moved at the timing of the arrival when the conveying unit is made to arrive at the entrance/exit portion of the specific cell.

12. The protecting method of accommodated items of claim 8, wherein both of the longitudinal bar and the lateral bar which cross at the specific cell are moved to a position that overlaps a partitioning wall of the specific cell.

13. A computer-readable medium storing a protecting program that is executed by a computer and that is for items accommodated in an accommodating shelf into/out of which the accommodated items are put/taken, the protecting program comprising:

obstructing the putting/taking the accommodated items into/out of a plurality of cells, which are arranged in longitudinal direction and lateral direction, and accommodate the accommodated items, by a plurality of longitudinal bars and lateral bars, each of the cells having an entrance/exit portion to put/take the accommodated items, a plurality of the longitudinal bars being disposed across the entrance/exit portions of the cells which are arranged in the longitudinal direction and being movable individually in the lateral direction to allow individual entrance/exit portions by a plurality of first drivers to be blocked and unblocked, a plurality of the lateral bars being disposed across the entrance/exit portions of the cells which are arranged in the lateral direction and being movable individually in the longitudinal direction by a plurality of second drivers to allow individual entrance/exit portions to be blocked and unblocked;

individually moving a longitudinal bar disposed in front of an entrance/exit portion of a specific cell selected from the cells in the lateral direction and a lateral bar disposed in front of an entrance/exit portion of the specific cell in the longitudinal direction to the outside of the entrance/exit portion of the specific cell, respectively, to allow an entrance/exit portion of the specific cell to be unblocked in case where the accommodated item in the specific cell is loaded in or loaded out; and individually moving the longitudinal bar and the lateral bar to a position where to cross at the specific cell after the accommodated item is loaded in or loaded out, wherein each entrance/exit portion of first cells forming a line with the specific cell in the longitudinal direction is blocked by each lateral bar disposed in front of the entrance/exit portions of the first cells though the moved longitudinal bar allows the entrance/exit portions of the first cells to be unblocked, and each entrance/exit portion of second cells forming a line with the specific cell in the lateral direction is blocked by each longitudinal bar disposed in front of the entrance/exit portions of the second cells though the moved lateral bar allows the entrance/exit portions of the second cells to be unblocked.

14. The computer-readable medium storing a protecting program for accommodated items of claim 13, wherein the longitudinal bars obstruct in the longitudinal direction the entrance/exit portions of or the front of the entrance/exit portions of the plurality of cells each accommodating the accommodated item and the lateral bars obstruct in the lateral direction the entrance/exit portions of or the front of the entrance/exit portions of the plurality of cells, the program further comprising selecting a specific cell into/out of which the accommodated item is loaded, using the longitudinal bars and the lateral bars.

15. The computer-readable medium storing a protecting program for accommodated items of claim 13, further comprising:

making a conveying unit configured to load the accommodated item into/out of the cell obstruct the entrance/exit portion of the specific cell, wherein the longitudinal bar and the lateral bar which cross at the specific cell are moved in case where the conveying unit obstructs the entrance/exit portion of the specific cell and putting in/taking out of the accommodated item in the specific cell.

16. The computer-readable medium storing a protecting program for accommodated items of claim 13, further comprising making a conveying unit configured to load the accommodated item into/out of the cell arrive at the entrance/exit portion of the specific cell, wherein the longitudinal bar and the lateral bar which cross at the specific cell are moved at the timing of the arrival when the conveying unit is made to arrive at the entrance/exit portion of the specific cell.

17. The computer-readable medium storing a protecting program for accommodated items of claim 13, wherein both of the longitudinal bar and the lateral bar which cross at the specific cell are moved to a position that overlaps a partitioning wall of the specific cell.

18. A system, comprising:

a plurality of cells, which are arranged in longitudinal direction and lateral direction, accommodating items with each cell, each of the cells having an entrance/exit portion to put/take the accommodated items;

first and second individually movable blocking members substantially perpendicularly crossing each other in each entrance/exit portion and allowing individual entrance/exit portions to be blocked and unblocked;

a plurality of first drivers configured to move the first blocking members individually in a first direction; and a plurality of second drivers configured to move the second blocking members individually in a second direction different from the first direction, wherein a position where the first and second blocking members cross each other, which is formed in front of an entrance/exit portion of thea specific cell, is changed when the first blocking member disposed in front of the entrance/exit portion of the specific cell is individually moved in the first direction and the second blocking member disposed in front of the entrance/exit portion of the specific cell is individually moved in the second direction to the outside of the entrance/exit portion of the specific cell, respectively, to allow the entrance/exit portion of the specific cell to be unblocked, wherein each entrance/exit portion of first cells forming a line with the specific cell in the longitudinal direction is blocked by each first blocking member disposed in front of the entrance/exit portions of the first cells though the moved second blocking member allows the entrance/exit portions of the first cells to be unblocked, and each entrance/exit portion of second cells forming a line with the specific cell in the lateral direction is blocked by each second blocking member disposed in front of the entrance/exit portions of the second cells though the moved first blocking member allows the entrance/exit portions of the second cells to be unblocked.

19. The system of claim 18, wherein the position where the first and second blocking members cross each other is moved to a position that overlaps a partitioning wall of the specific cell.

* * * * *

UNITED STATES PATENT AND TRADEMARK OFFICE

CERTIFICATE OF CORRECTION

PATENT NO. : 8,359,986 B2
APPLICATION NO. : 11/948387
DATED : January 29, 2013
INVENTOR(S) : Yukio Sekiguchi et al.

It is certified that error appears in the above-identified patent and that said Letters Patent is hereby corrected as shown below:

In the Claims:

Column 15, Line 15, In Claim 5, delete “thea” and insert -- a --, therefor.
Column 15, Line 25, In Claim 6, delete “thea” and insert -- a --, therefor.
Column 18, Line 26, In Claim 18, delete “thea” and insert -- a --, therefor.

Signed and Sealed this
Thirtieth Day of April, 2013

Teresa Stanek Rea
*Acting Director of the United States Patent and Trademark Office*